US011109670B2

(12) United States Patent
Payne et al.

(10) Patent No.: US 11,109,670 B2
(45) Date of Patent: Sep. 7, 2021

(54) FLIP TOP TABLE

(71) Applicant: Steelcase Inc., Grand Rapids, MI (US)

(72) Inventors: Jamie Payne, Grand Rapids, MI (US); Brian K. Snyder, Middleville, MI (US); Sean M. Derrick, Kalamazoo, MI (US); David K. Jones, Grand Rapids, MI (US); David J. Battey, Caledonia, MI (US); Ivan Colin, Otsego, MI (US); Christopher Gale Inman, Trufant, MI (US)

(73) Assignee: Steelcase Inc., Grand Rapids, MI (US)

( * ) Notice: Subject to any disclaimer, the term of this patent is extended or adjusted under 35 U.S.C. 154(b) by 1 day.

(21) Appl. No.: 16/388,315

(22) Filed: Apr. 18, 2019

(65) Prior Publication Data

US 2019/0307242 A1 Oct. 10, 2019

Related U.S. Application Data

(63) Continuation of application No. PCT/US2017/058515, filed on Oct. 26, 2017.
(Continued)

(51) Int. Cl.
*A47F 5/12* (2006.01)
*A47B 3/08* (2006.01)
(Continued)

(52) U.S. Cl.
CPC ..... *A47B 3/08* (2013.01); *A47B 17/036* (2013.01); *A47B 41/02* (2013.01); *A47B 41/06* (2013.01);
(Continued)

(58) Field of Classification Search
CPC ..... A47G 25/0685; A47B 2200/0031; A47B 2200/0036; A47B 2200/0037;
(Continued)

(56) References Cited

U.S. PATENT DOCUMENTS 244,510 A 7/1881 Abernathy
909,720 A 1/1909 Webb
(Continued)

FOREIGN PATENT DOCUMENTS

CN 2219048 Y 2/1996
CN 200998014 Y 1/2008
(Continued)

*Primary Examiner* — Matthew W Ing
(74) *Attorney, Agent, or Firm* — Crowell & Moring LLP

(57) ABSTRACT

A flip top table includes a leg assembly supporting an axle defining a rotation axis extending in a longitudinal direction. A strike plate is non-rotatably secured to the axle, with the strike plate having first and second circumferentially spaced and radially extending stop surfaces. A worksurface is rotatably supported on the axle and includes first and second circumferentially spaced stop surfaces. The worksurface is rotatable about the rotation axis between a use position and a stowed position. A latch assembly is coupled to and rotatable with the worksurface between the use and stowed positions. The latch assembly includes a lock bolt moveable in the longitudinal direction between a disengaged position, wherein the lock bolt is longitudinally displaced from the strike plate, and an engaged position, wherein the lock bolt engages the second stop surface of the strike plate when the worksurface is in the use position. An actuation mechanism is also provided.

21 Claims, 29 Drawing Sheets

Related U.S. Application Data

(60) Provisional application No. 62/413,566, filed on Oct. 27, 2016.

(51) Int. Cl.

| | |
|---|---|
| ***A47B 17/03*** | (2006.01) |
| ***A47B 41/02*** | (2006.01) |
| ***A47B 83/04*** | (2006.01) |
| ***A47B 41/06*** | (2006.01) |
| *A47B 7/02* | (2006.01) |

(52) U.S. Cl.
CPC ..... *A47B 83/04* (2013.01); *A47B 7/02* (2013.01); *A47B 2200/0031* (2013.01); *A47B 2200/0036* (2013.01); *A47B 2200/0037* (2013.01); *A47B 2200/0085* (2013.01)

(58) Field of Classification Search
CPC . A47B 2200/0085; A47B 3/08; A47B 17/036; A47B 41/02; A47B 41/06; A47B 83/04; A47B 7/02
See application file for complete search history.

(56) References Cited

U.S. PATENT DOCUMENTS 1,003,513 A 9/1911 Rosset et al.
1,093,050 A 4/1914 Heckel
1,094,900 A 4/1914 Hoit
1,106,342 A 8/1914 Bristol
1,123,531 A 1/1915 Herzberg
1,127,559 A 2/1915 Willison
1,452,367 A 4/1923 Ellingson
1,876,010 A 9/1932 Kusterle
1,890,986 A 12/1932 Hanley
1,938,507 A 12/1933 Wilson
2,003,835 A 6/1935 Mitchell
2,030,348 A 2/1936 Barrett
2,049,221 A 7/1936 Rastetter
2,121,398 A 6/1938 Dukes
2,230,220 A 2/1941 Cummins
2,461,385 A 2/1949 Logue
2,463,082 A 3/1949 Brown
2,497,552 A 2/1950 Ledel
2,660,498 A 11/1953 Norquist
2,690,368 A 9/1954 Troyke
2,714,543 A 8/1955 Hosler
3,134,269 A 5/1964 Shimanckas
3,153,526 A * 10/1964 Pawsey ..... A47B 96/061 248/219.1
3,484,069 A * 12/1969 Larson ..... A47F 5/0823 248/220.42
3,641,946 A 2/1972 Charnay
3,861,329 A 1/1975 Kitchen, Sr.
3,905,310 A 9/1975 Hager
4,051,953 A 10/1977 Shoaf
4,081,166 A 3/1978 Lippert
4,268,960 A 5/1981 Reinschreiber
4,312,455 A 1/1982 Weber
4,383,488 A 5/1983 Macho et al.
4,413,570 A 11/1983 Haigh
4,561,622 A 12/1985 Heinzel
4,634,090 A 1/1987 Currie et al.
4,688,748 A 8/1987 Pruyser
4,879,954 A 11/1989 Sawamura et al.
4,884,513 A 12/1989 Newhouse et al.
4,896,424 A 1/1990 Walker
4,930,962 A 6/1990 Reynolds
4,955,294 A 9/1990 Abe
5,056,577 A 10/1991 DeLong et al.
5,092,253 A 3/1992 Grund et al.
5,152,582 A 10/1992 Magnuson
5,230,290 A 7/1993 Crossman
5,298,681 A 3/1994 Swift et al.
5,301,477 A 4/1994 Rellinger et al.
5,323,713 A 6/1994 Luyk et al.
5,328,068 A 7/1994 Shannon
5,333,978 A 8/1994 Rives
5,354,027 A 10/1994 Cox
5,383,318 A 1/1995 Kelley et al.
5,403,109 A 4/1995 Johnson et al.
5,469,893 A 11/1995 Caveney et al.
5,528,996 A 6/1996 Edwards et al.
5,673,633 A 10/1997 Pfister
5,753,855 A 5/1998 Nicoli et al.
5,755,035 A 5/1998 Weatherly
5,782,447 A 7/1998 Hoffend
5,820,208 A 10/1998 Milkinevich
5,845,589 A 12/1998 Pfister
5,910,351 A 6/1999 Davis et al.
5,917,982 A 6/1999 Vargas et al.
5,962,809 A 10/1999 Duvall et al.
5,974,982 A 11/1999 Lepper et al.
6,109,579 A 8/2000 Huang
6,216,746 B1 4/2001 Guebre-Tsadik et al.
6,284,975 B1 9/2001 McCord et al.
6,318,684 B1 11/2001 Ireland et al.
6,336,414 B1 1/2002 Stewart et al.
6,394,005 B1 5/2002 Isensee et al.
6,397,762 B1 6/2002 Goldberg et al.
6,591,451 B2 7/2003 Gruber et al.
6,637,352 B1 10/2003 Thode et al.
6,643,897 B2 11/2003 Chang
6,681,704 B1 1/2004 Brookhiser
6,845,723 B2 1/2005 Kottman et al.
6,854,202 B1 2/2005 Ives et al.
7,034,227 B2 4/2006 Fox
7,104,742 B1 9/2006 Fitts, III
7,118,082 B2 10/2006 Brnjac
7,219,868 B2 5/2007 Marler et al.
7,246,978 B2 7/2007 Morishima et al.
7,304,240 B1 12/2007 Gretz
7,325,343 B2 2/2008 Seiber et al.
7,350,469 B2 4/2008 Koning et al.
7,429,024 B2 9/2008 Boklund-Moran
7,484,819 B2 2/2009 Frederick et al.
7,490,562 B2 2/2009 Cornilleau
7,524,130 B2 4/2009 Zenda et al.
7,614,351 B2 11/2009 Piretti
7,634,968 B2 12/2009 Cornelius
7,798,455 B2 2/2010 Kumazawa
7,669,822 B2 * 3/2010 Kluge ..... F16B 45/02 248/308
7,677,184 B2 3/2010 Dhanoa et al.
7,681,851 B1 3/2010 Osterholt et al.
7,703,400 B2 4/2010 Mockel
7,765,938 B2 8/2010 Piretti
7,836,833 B2 11/2010 Kumazawa
7,871,280 B2 1/2011 Henriott
7,878,128 B2 2/2011 Watson et al.
7,975,624 B2 7/2011 Henriott
8,051,784 B2 11/2011 Hsu
8,051,785 B2 11/2011 Lin
8,069,795 B1 12/2011 Williams et al.
8,091,488 B2 1/2012 Chirea et al.
8,146,514 B2 4/2012 Hamilton et al.
8,171,863 B2 5/2012 Nyenhuis et al.
8,172,496 B2 5/2012 Vile et al.
8,196,525 B2 6/2012 Flanet
8,201,505 B2 6/2012 Long
8,225,723 B2 7/2012 Nakamura et al.
8,272,336 B2 9/2012 Rutz
8,291,830 B2 10/2012 Rutz
8,413,593 B2 4/2013 Korb
8,413,594 B2 4/2013 Ensley
8,424,413 B2 4/2013 Rutz
8,474,385 B2 7/2013 Saito
8,550,417 B2 10/2013 Lee et al.
8,578,864 B2 11/2013 Nyenhuis et al.
8,702,050 B2 4/2014 Cohen
8,794,161 B2 9/2014 Lu et al.
8,967,579 B2 3/2015 Tsai
9,003,981 B2 4/2015 Lio et al.
9,066,589 B2 6/2015 Battey

(56) References Cited

U.S. PATENT DOCUMENTS

| | | | | |
|---|---|---|---|---|
| 9,138,051 | B2 | 9/2015 | Pan | |
| 9,144,300 | B2 | 9/2015 | Cotey | |
| 9,265,340 | B2 | 2/2016 | Krusin et al. | |
| 9,538,839 | B2 | 1/2017 | Favaro | |
| 9,609,945 | B2 | 4/2017 | Krusin et al. | |
| 9,625,669 | B2 | 4/2017 | Tally et al. | |
| 9,752,605 | B2 | 9/2017 | Papadopoulos | |
| 10,030,424 | B2 | 7/2018 | Tsuchiyama et al. | |
| 2002/0047079 | A1 | 4/2002 | Gerson | |
| 2002/0096606 | A1 | 7/2002 | Bernard et al. | |
| 2003/0000434 | A1 | 1/2003 | Igiseder et al. | |
| 2003/0031531 | A1 | 2/2003 | Aldridge | |
| 2004/0149880 | A1 | 8/2004 | Mitchell et al. | |
| 2004/0211584 | A1 | 10/2004 | Vandervelde | |
| 2007/0092196 | A1 | 4/2007 | Bayazit et al. | |
| 2008/0149002 | A1* | 6/2008 | Gardner | A47B 13/023 108/6 |
| 2008/0178778 | A1 | 7/2008 | Koning et al. | |
| 2008/0196635 | A1 | 8/2008 | Piretti | |
| 2009/0108160 | A1* | 4/2009 | Kluge | F16B 45/02 248/308 |
| 2009/0114130 | A1 | 5/2009 | Chirea et al. | |
| 2009/0180830 | A1 | 7/2009 | MacLean | |
| 2011/0262245 | A1 | 10/2011 | Michiwaki | |
| 2014/0017035 | A1 | 1/2014 | Michiwaki | |
| 2014/0038164 | A1* | 2/2014 | Battey | A47B 83/00 434/365 |
| 2014/0048662 | A1 | 2/2014 | Ferris | |
| 2014/0326844 | A1 | 11/2014 | Sullivan | |
| 2014/0339858 | A1 | 11/2014 | Lokken | |
| 2015/0118010 | A1 | 4/2015 | Krusin et al. | |
| 2015/0164217 | A1 | 6/2015 | Samikkannu et al. | |
| 2016/0066729 | A1* | 3/2016 | Pratt | A47G 25/0685 211/85.3 |
| 2017/0000259 | A1 | 1/2017 | Tsuchiyama et al. | |
| 2017/0051869 | A1 | 2/2017 | Hsiao | |
| 2018/0119722 | A1 | 5/2018 | Vik | |
| 2018/0153301 | A1 | 6/2018 | Saotome | |

FOREIGN PATENT DOCUMENTS

| | | | |
|---|---|---|---|
| CN | 202375399 | U | 8/2012 |
| CN | 202681053 | U | 1/2013 |
| DE | 445509 | C | 6/1927 |
| DE | 574299 | C | 4/1933 |
| DE | 8705611 | U | 6/1987 |
| DE | 9417285 | U1 | 12/1994 |
| DE | 29722359 | | 2/1998 |
| DE | 102005037394 | | 2/2007 |
| DE | 202012010008 | | 1/2013 |
| EP | 0176955 | B1 | 7/1990 |
| EP | 736272 | | 10/1996 |
| EP | 1308109 | | 5/2003 |
| EP | 0797941 | | 8/2004 |
| EP | 2163170 | | 3/2010 |
| EP | 2570566 | A2 | 3/2013 |
| EP | 2599404 | A1 | 6/2013 |
| EP | 1857689 | B1 | 12/2016 |
| EP | 3203351 | A1 | 8/2017 |
| FR | 729898 | A | 5/1932 |
| FR | 2866792 | | 9/2005 |
| GB | 422555 | | 1/1935 |
| GB | 688155 | | 2/1953 |
| GB | 741469 | A | 12/1955 |
| GB | 866092 | | 4/1961 |
| GB | 900241 | | 7/1962 |
| GB | 2322907 | | 9/1998 |
| GB | 2430874 | | 1/2008 |
| JP | 54116695 | A | 9/1979 |
| JP | 06284929 | A | 10/1994 |
| JP | 2000189256 | | 7/2000 |
| JP | 2014108253 | | 6/2014 |
| WO | WO200154538 | A1 | 8/2001 |
| WO | WO02091878 | A1 | 11/2002 |
| WO | WO2005104902 | | 11/2005 |
| WO | WO2006028327 | | 3/2006 |
| WO | WO2008152007 | | 12/2008 |
| WO | WO2009110489 | A1 | 11/2009 |
| WO | WO2011145350 | | 11/2011 |
| WO | WO2011162998 | A1 | 12/2011 |
| WO | WO201361345 | | 5/2013 |
| WO | WO2014116972 | | 7/2014 |
| WO | WO2016092572 | | 6/2016 |
| WO | WO2017084192 | | 5/2017 |

* cited by examiner

FLIP TOP TABLE

This application is a continuation of International Application PCT/US2017/058515, with an international filing date of Oct. 26, 2017, which claims the benefit of U.S. Provisional Application No. 62/413,566, filed Oct. 27, 2016, the entire disclosure of which is hereby incorporated herein by reference.

FIELD OF THE INVENTION

The present application relates generally to a table, and in particular to a table having a flip top and to various latch mechanisms, user interfaces and accessories associated with the flip top table.

BACKGROUND

Tables may be configured with flip tops, which are pivotable to an upright stowed position so as to allow for the tables to be more easily stored and transported. In some situations, the flip top and actuating mechanism may introduce various pinch points. Moreover, the mechanisms may be relatively complex and difficult to manufacture and assemble. Over time, the mechanisms may wear or become loose.

In addition, flip top tables often are configured with a pair of leg assemblies, with each leg assembly having a latching mechanism engaged with the rotating table top. In many embodiments, it may be difficult to coordinate the release of both mechanisms such that the table top may be rotated.

SUMMARY

The present invention is defined by the following claims, and nothing in this section should be considered to be a limitation on those claims.

In one aspect, one embodiment of a flip top table includes a leg assembly supporting an axle defining a rotation axis extending in a longitudinal direction. A strike plate is non-rotatably secured to the axle, with the strike plate having first and second circumferentially spaced and radially extending stop surfaces. A worksurface is rotatably supported on the axle and includes first and second circumferentially spaced stop surfaces. The worksurface is rotatable about the rotation axis between a use position and a stowed position, wherein the first stop surface of the worksurface engages the first stop surface of the strike plate when the worksurface is in the use position, and wherein the second stop surface of the worksurface engages the second stop surface of the strike plate when the worksurface is in the stowed position. A latch assembly is coupled to and rotatable with the worksurface between the use and stowed positions. The latch assembly includes a lock bolt moveable in the longitudinal direction between a disengaged position, wherein the lock bolt is longitudinally displaced from the strike plate, and an engaged position, wherein the lock bolt engages the second stop surface of the strike plate when the worksurface is in the use position. In one embodiment the table may include a pair of leg assemblies and latch assemblies. In one embodiment, the lock bolt may include a tapered latch surface. In addition, at least one of the first stop surfaces of the strike plate and/or the worksurface may be circumferentially adjustable.

In another aspect, one embodiment of an actuation mechanism includes a housing defining a guide. A lever is pivotally mounted to the housing about a first axis. The lever is pivotable between first and second positions. A slider is pivotally coupled to the lever about a second axis spaced from the first axis. The slider is translatably moveable in the guide between first and second positions as the lever is pivoted between the first and second positions. First and second cables have ends coupled to the slider at spaced apart locations. The ends of the first and second cables are moved equidistance as the lever is pivoted from the first position to the second position. The ends of the first and second cables are moveable in the track relative to the slider as the lever is pivoted from the second position to the first position.

In another aspect, one embodiment of a method for rotating a flip top table includes positioning the worksurface in a use position, wherein the first stop surface of the worksurface engages the first stop surface of the strike plate and wherein the lock bolt engages the second stop surface of the strike plate, moving the lock bolt in the longitudinal direction and thereby disengaging the lock bolt from the second stop surface of the strike plate, and rotating the worksurface from the use position to a stowed position and engaging the second stop surface of strike plate with the second stop surface of the worksurface.

In yet another aspect, one embodiment of a method of simultaneous dual actuation includes pivoting a lever about a first axis between first and second positions, pivoting a slider relative to the lever, translating the slider along a linear path between first and second positions as the lever is pivoted between the first and second positions, and moving first and second cables having ends coupled to the slider at spaced apart locations, wherein the ends of the first and second cables are moved equidistance as the lever is pivoted from the first position to the second position. The method further includes pivoting the lever from the second position to the first position and maintaining the position of the first and second cables while moving the slider relative to the ends of the first and second cables as the lever is pivoted from the second position to the first position.

In yet another aspect, a flip top table includes a leg assembly, a worksurface having a top and bottom surface and a storage hook. The worksurface is rotatably supported by the leg assembly and is rotatable between a horizontal use position and an upright stowed position. The storage hook includes a base coupled to the bottom surface of the worksurface and a hook portion pivotally coupled to the base. A panel is supported by the hook portion, wherein the hook portion and panel are pivotable relative to the base and worksurface between a first position, wherein the panel is positioned transverse to the worksurface when the worksurface is in the use position, and a second position, wherein the panel is positioned substantially parallel to the worksurface when the worksurface is in the stowed position.

In yet another aspect, a method of supporting a panel on a flip top table includes rotating a worksurface relative to a leg assembly between a horizontal use position and an upright stowed position, supporting a panel on a hook portion pivotally coupled to a bottom of the worksurface, wherein the panel extends transverse to the worksurface when the worksurface is in the use position, and rotating the panel and hook portion relative to the worksurface as the worksurface is rotated to the stowed position, wherein the panel extends parallel to the worksurface when the worksurface is in the stowed position.

A table kit includes a worksurface and a leg adapter coupled to the worksurface. The leg adapter has a bottom surface, a pair of laterally spaced bosses extending downwardly from the bottom surface, a pair of laterally spaced through openings formed in the bosses, and a central opening positioned between the pair of through openings. A first leg includes a pair of tubes shaped to receive the bosses. A pair of first fasteners is dimensioned to extend through the through openings and threadably engage the pair of tubes respectively. A second leg has a top end shaped to receive the bosses. A second fastener is adapted to be coupled to the second leg and the adapter at the central opening.

In yet another aspect, one embodiment of a flip top table includes a first leg assembly and a second leg assembly longitudinally spaced from the first leg assembly. A cross bar extends between and is connected to the first and second leg assemblies. A worksurface is rotatably supported by the first and second leg assemblies. A shroud is coupled to the worksurface and extends between the first and second leg assemblies. The shroud at least partially encircles the cross bar, with the worksurface and shroud being rotatable relative to the cross bar and capable of transferring a load from the worksurface to the cross bar.

The various embodiments of the flip top table, actuation mechanism and methods provide significant advantages over other flip top tables and actuation mechanisms. For example and without limitation, the table is configured without any pinch points. Moreover, the latching interface is self-adjusting over time, thereby making the system long lived and robust. In addition, the actuation mechanism, and user interface in particular, leverages the pivoting action of a lever while allowing for simultaneous and equidistant movement of the actuation cables. The hook and panel also provide a convenient way to store panels on a flip top table. In various embodiments, the panels may function as a privacy panel when disposed under the worksurface, or may be repositioned as a display panel. In addition, the leg adapter provides a modular system configured to support a variety of differently configured legs, thereby allowing the end user to customize the appearance of the table.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "longitudinal," as used herein means of or relating to a length or lengthwise direction 2, for example a direction running from one end of a worksurface to another end, and vice versa, or running along a length of a support leg. The term "lateral," as used herein, means situated on, directed toward or running in a front-to-back direction 4 of the worksurface or leg. The term "coupled" means connected to or engaged with whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," "right," "left," and variations or derivatives thereof, refer to the orientations of the exemplary table as shown in FIGS. 1 and 2 with a user positioned along a front thereof. The term "transverse" means non-parallel.

As referred to herein, the phrase "pinch points" are defined as a mechanical hazard, based upon guidance from the U.S. Federal Regulations for consumer products (CPSC 16 CFR Ch. II), industry standards (ANSI/BIFMA, UL) and European Norms (EN), with a clearance between adjustable surfaces and adjacent surfaces being less than 1.0 inches (25 mm), and with clearance between all moving components (other than adjustable surfaces) being greater than 0.190 inches (5 mm) or less than 1.0 inches (25 mm). Accordingly, when pinch points are referred to herein as being "avoided," "eliminated," or some other equivalent qualifier, it means any gaps or clearances between the noted structures fall outside of these defined ranges, whether less than or greater than the noted dimensions.

Figure 12C:
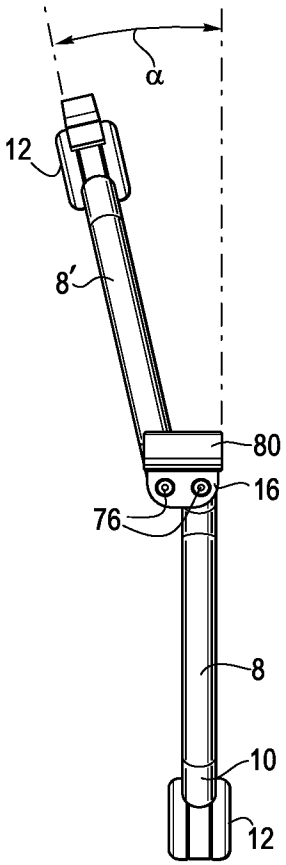
FIGS. 12A-C are perspective views of one embodiment of a support leg with and without an adapter, and a top view of the support leg with the adapter respectively.
Figure 12B:
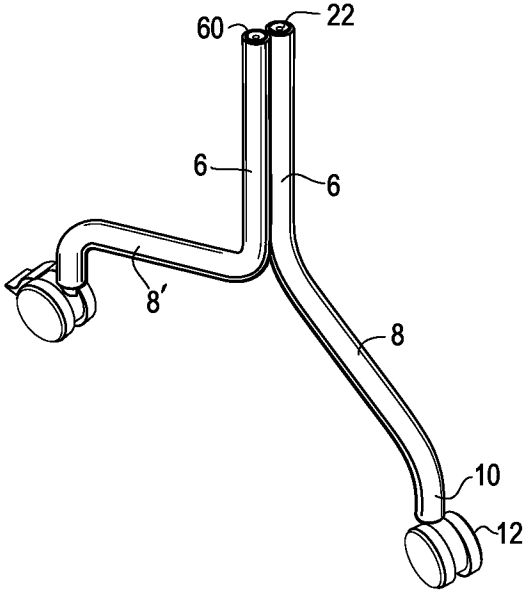

Leg Assemblies:

Referring to FIGS. 1A-5, a flip top table 20 includes a pair of leg assemblies 24, 26, otherwise referred to as first and second leg assemblies. The leg assemblies 24 include an upright portion 6 and a pair of outriggers 8, 8' extending outwardly from the upright portion. Each of the outriggers includes a foot 10 terminating at a floor engaging member 12, which may be configured as a caster, glide or other interface. In one embodiment, shown in FIGS. 4 and 12C, a first outrigger 8, for example an outrigger positioned along the front of the table, is arranged to extend outwardly at an angle $\alpha$ relative to a plane 14 defined by a second outrigger 8', which may extend for example along a lateral direction 4. In this arrangement, adjacent tables may be nested as shown for example in FIGS. 3-5. In various embodiments, $\alpha$ is between 0 and 20 degrees, more preferably between 10 and 15 degrees, and preferably 12 degrees.

The leg assemblies 24, 26 may be configured in different modules, with a modular leg adapter 16 suitable for interfacing with the leg modules. In this way, a table kit may be provided, allowing the end user to select from a menu of different leg assemblies, which may vary in appearance, finish and cost.

Figure 10:
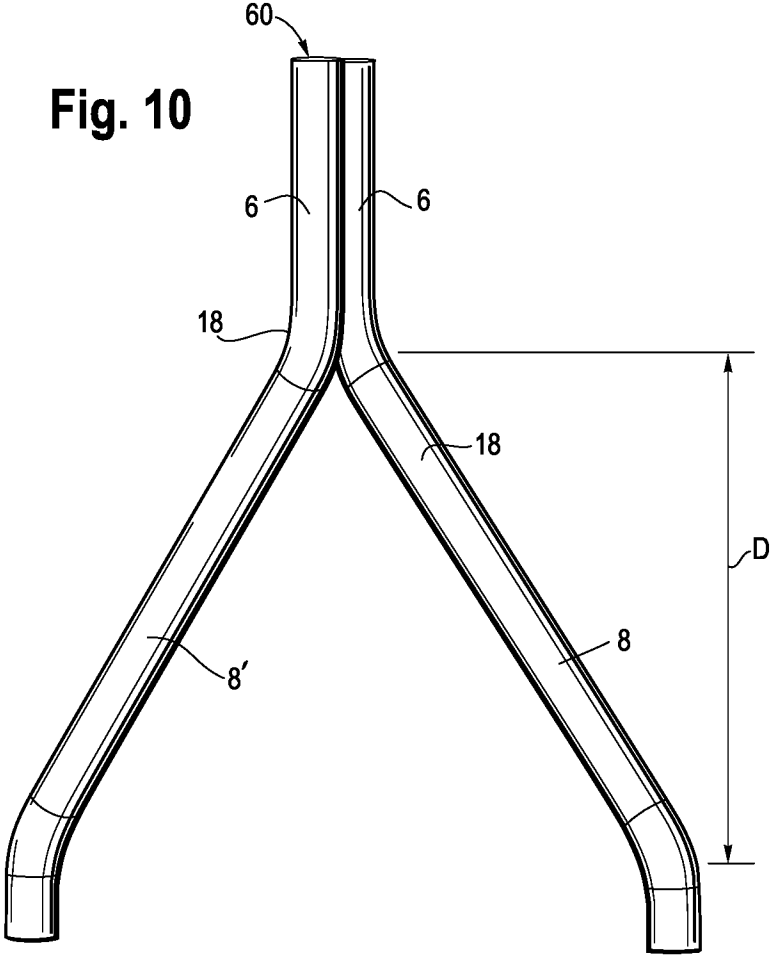
FIG. 10 is a perspective view of an alternative embodiment of a support leg.
Figure 12A:
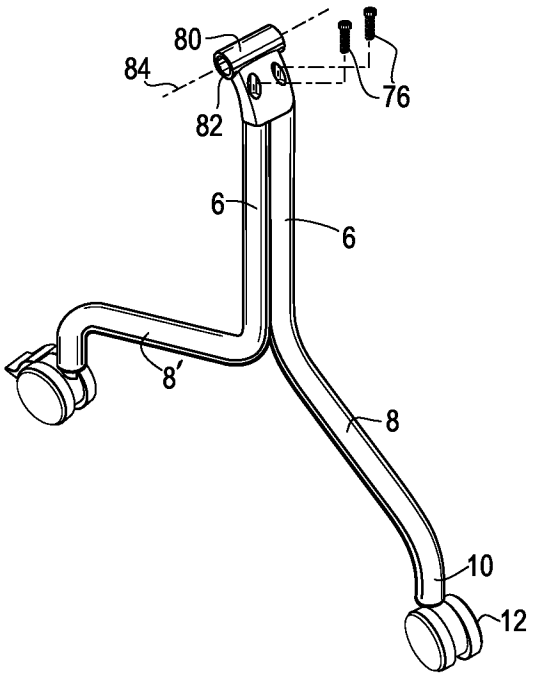

In one embodiment, shown in FIGS. 11 and 12A-C, the leg assembly 24 module includes a pair of bent tubes 18, each having an upright portion 6, an outrigger portion 8, 8' and a downturned foot portion 10, which may be open to receive a floor engaging member 12. The tubes may be made of various materials, including steel, aluminum, plastic, fiberglass, or combinations thereof. The tubes may be coupled together along the upright portion 6, for example by welding, bonding or with mechanical fasteners. The angle $\alpha$ between the outrigger portions 8, 8' may be easily modified by rotating the tubes prior to welding. A nut 22, as shown in FIG. 12A, is welded in the upper portion of each of the tube uprights 6. As shown in the embodiment of FIG. 10, the outriggers 8, 8' have a greater vertical displacement D than the vertical displacement d of the outriggers 8, 8' shown in FIG. 11.

Figure 9A:
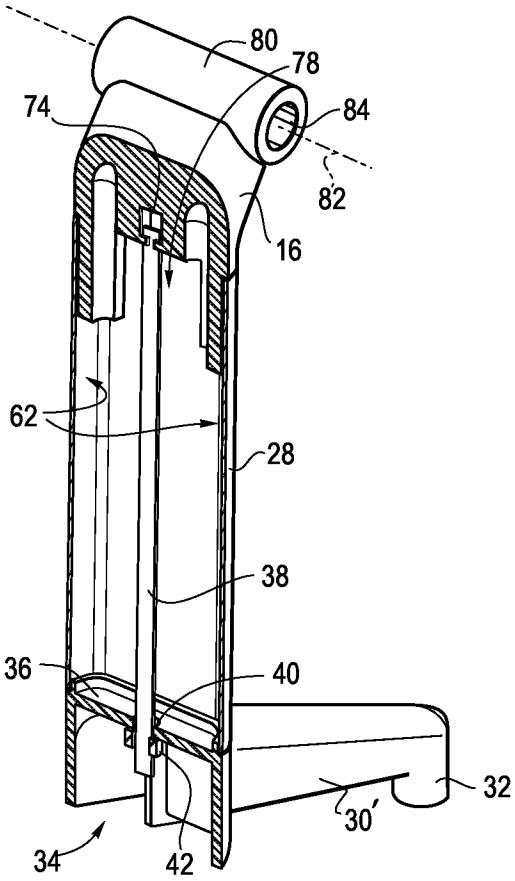
FIG. 9A is a cross-sectional view of the support leg shown in FIG. 9.
Figure 9:
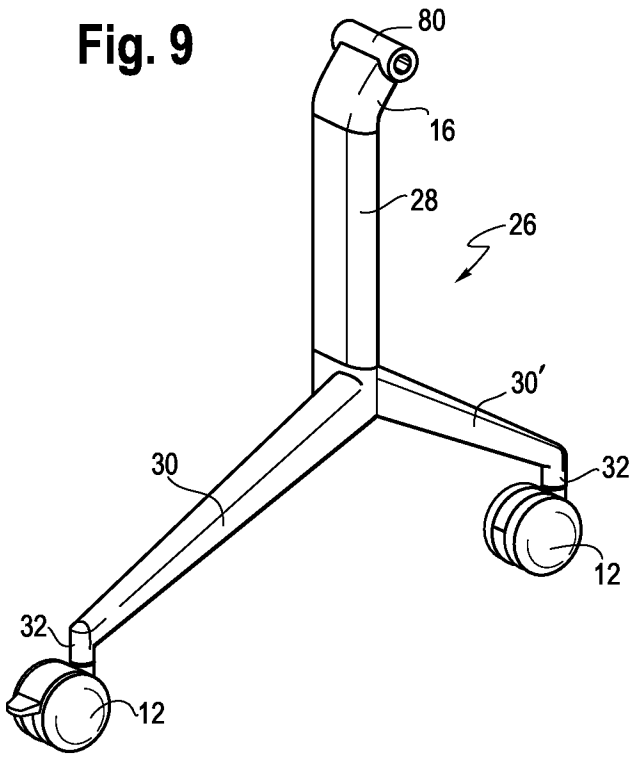
FIG. 9 is a perspective view of one embodiment of a support leg.
Figure 11:
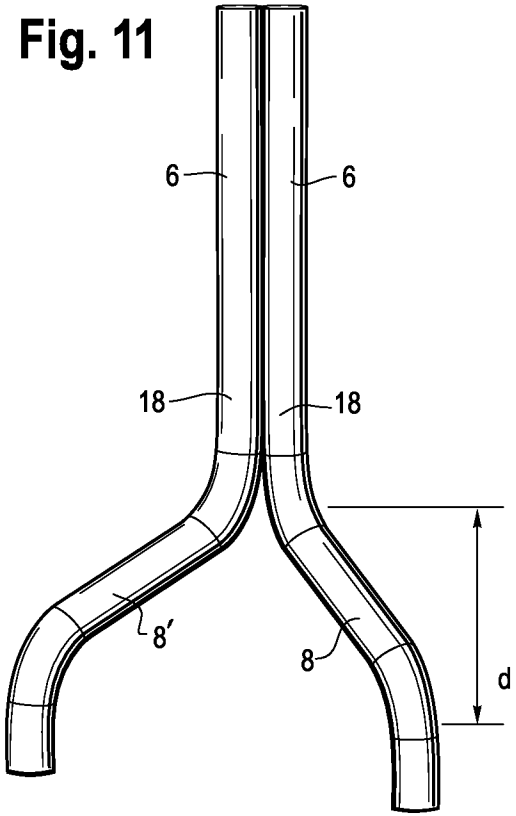
FIG. 11 is a perspective view of an alternative embodiment of a support leg.
Figure 29:
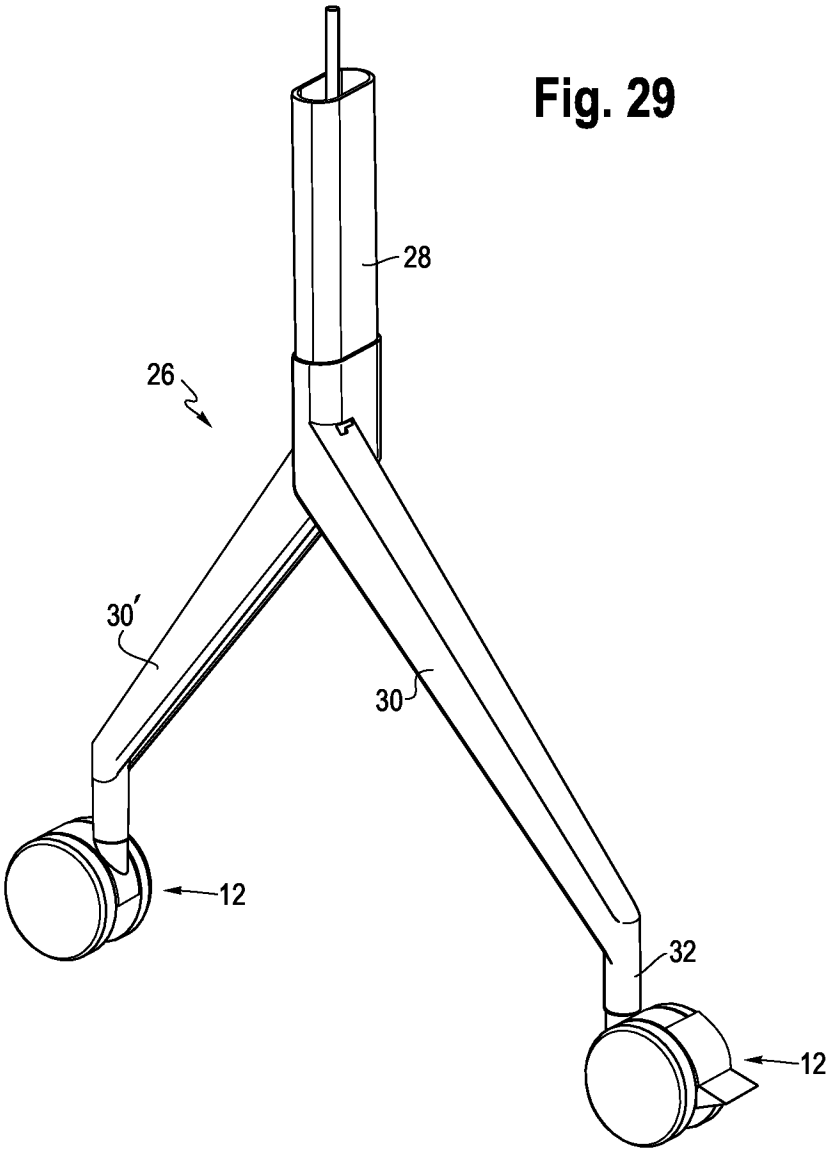
FIG. 29 is a perspective view of one embodiment of a support leg.

Referring to FIGS. 9, 9A and 29, another embodiment of a leg assembly 26 is configured as a casting, for example aluminum, or with a chrome finish. As with the tubular legs, the leg includes an upright portion 28 and a pair of outriggers 30, 30', which may be arranged as noted above to define an angle $\alpha$. The ends of the outriggers terminate in a foot 32, which are configured to receive a floor engaging member 12. As shown in FIG. 9A, the upright has an open bottom 34, with a shelf 36 extending across the upright. A fastener 38, for example a threaded shaft, may extend downwardly from the adapter through an opening 40 in the shelf. The adapter 16 may include a shoulder to engage a head of the fastener. A nut 42 may be threadably secured to the fastener 38 so as to put the fastener in tension, thereby securing the leg 26 to the adapter 16. Conversely, a fastener may extend upwardly through the opening 40, engaging the bottom of the shelf, and threadably engage the adapter at central opening 74. In one embodiment, the adapter may include a shoulder portion that is received in an open end of the leg. As shown in the embodiment of FIG. 29, the outriggers 30, 30' have a greater vertical displacement than the vertical displacement of the outriggers 30, 30'shown in FIG. 9.

Figure 13:
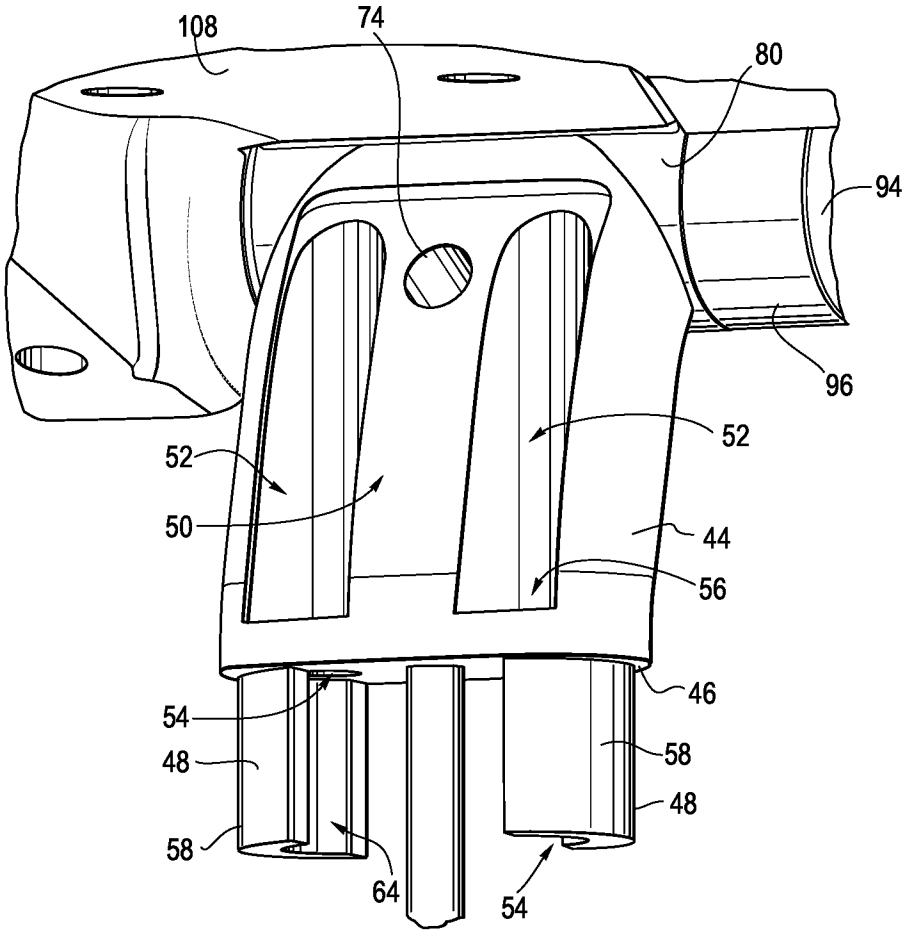
FIG. 13 is a partial view of a leg adapter.

As noted above, the adapter 16 may be modular, meaning it is configured to interface with both the tubular and cast legs 18, 26. The adapter may be made out of metal, for example aluminum, or hard plastic. The outer surface or profile of an adapter housing 44 may be flush with, or match, the outer surface or profile of the legs 26, 28, so as to provide a continuous and smooth transition between the legs and adapter, thereby providing an appearance of a single component. In one embodiment, the adapter housing 44 having a bottom surface 46 with a pair of bosses 48 extending downwardly from the bottom surface. The bosses may be configured as insert portions, or posts. The housing defines a cavity 50 with a pair of recesses 52 formed in an upper portion thereof. Through holes 54, defined in part by the recesses, extend through a floor 56 of the housing, the bottom surface 46, and the bosses 48. The bosses 48 have outer bearing surfaces 58, which are curved or otherwise shaped to mate with an inner surface 60, 62 of the tube uprights 8, 8', 28. The bosses may be open along an inner side 64 as shown in FIG. 13.

Figure 14B:
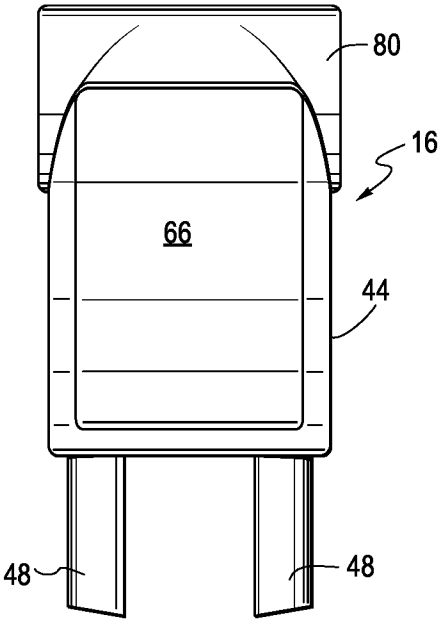
FIGS. 14A and B are open and closed configurations of one embodiment of a leg adapter.
Figure 14A:
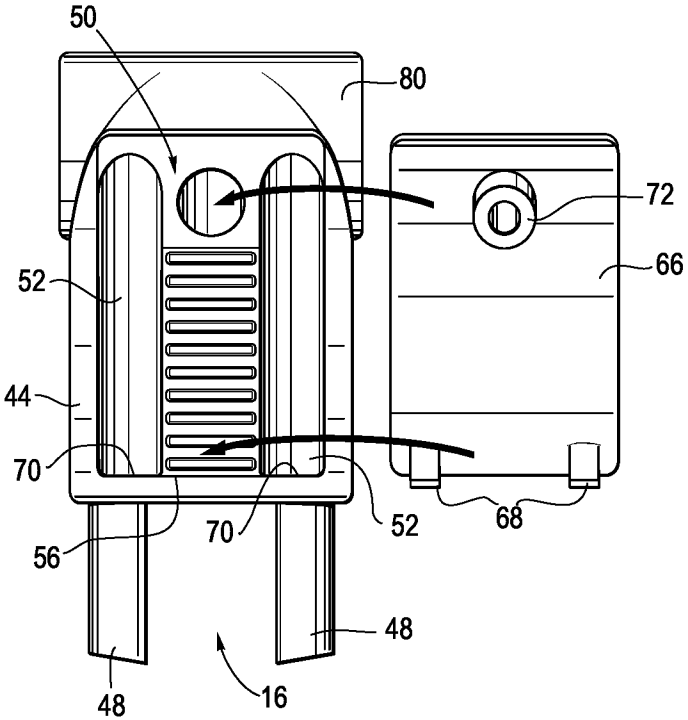
Figure 15B:
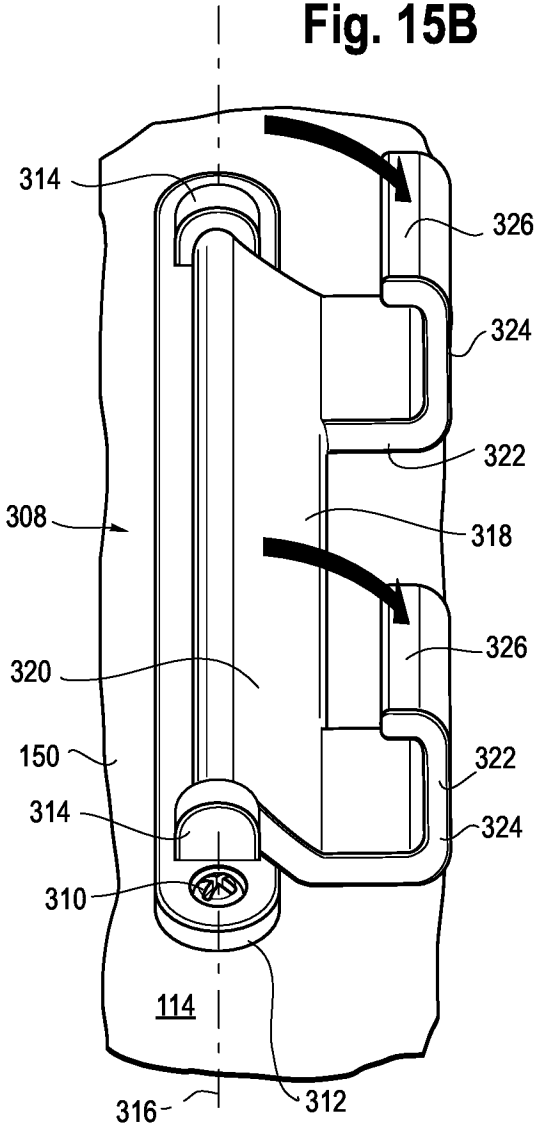
FIGS. 15A and B are views of a hook in first and second holding configurations.
Figure 15A:
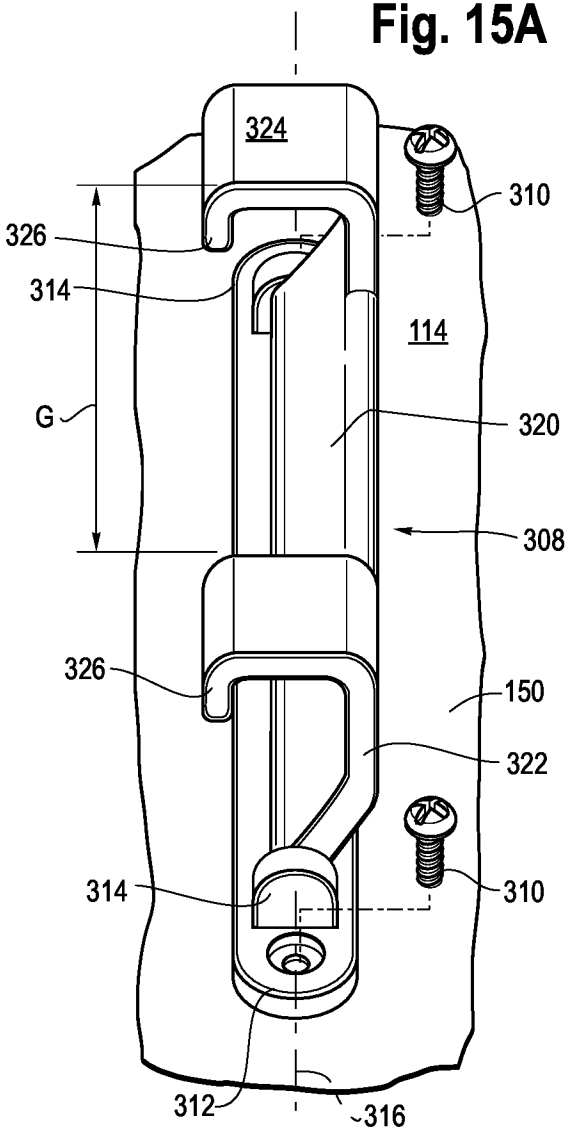
Figure 27:
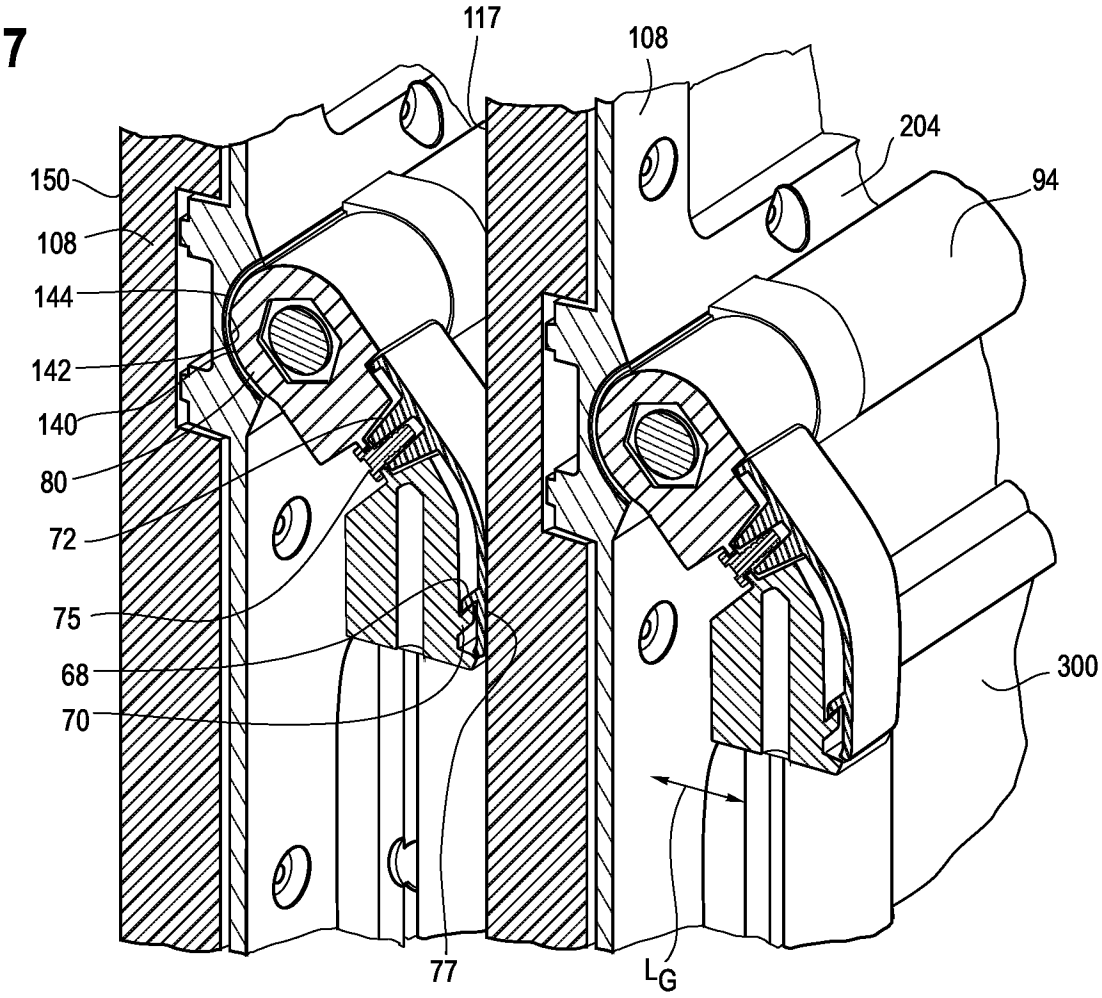
FIG. 27 is a partial cross-sectional view of a pair of nested tables in the stowed position.

As shown in FIGS. 14A, B and 27, a cover 66, made in one embodiment from the same materials as the housing, may be secured to the housing 44 to close the cavity 50 and hide or cover the recesses 52 and through openings 54. In other embodiments, shown for example in FIG. 12A, the cover may be omitted. The cover may include a pair of tabs 68, which are received in over a catch 70, formed for example by an edge, shelf or openings, e.g., slots, formed in the floor of the housing. The tabs are inserted in the openings, with the cover then being rotated to a closed position (FIGS. 14B and 27). The cover 66 includes a boss 72 received in a central through opening 74 positioned between the pair of through openings. A fastener 75 may be installed from the other side of the housing and threadably engage the boss to secure the cover. The outer surface of the cover may be configured with a pad or bumper 77, such that adjacent nested tables engage the bumper as shown in FIG. 27, thereby preserving the top surface 117 of the adjacent worksurface.

During assembly, the tube uprights 6 of leg assembly 24 are inserted over the bosses 48, with the outer bearing surfaces 58 of the bosses mating with the inner surface 60 of the tubes. Because the bosses 48 are spaced apart, they are able to receive the pair of tubes. A pair of fasteners 76 is inserted through the through holes 54 and into threadable engagement with the nuts 22. The cover 66 may then be secured over the cavity as shown in FIG. 14B.

If the other leg assembly 26 is being used, the bosses 48 are inserted into a top portion of the leg defining a single tube having a single opening 78, again with the outer bearing surfaces mating with the inner surface of the tube. The opening 78 is elongated (e.g., obround, oval or defining a non-circular ellipse. In this way, the adapter provides for either a pair of upright tubes, or a single upright tube, to be fitted over the same pair of bosses. A fastener 38 is inserted through the central through opening 74, through the opening 40 in the shelf 36 and is engaged by a fastener 42 bearing against the shelf. The fasteners 38, 42 may tightened to put the fastener 38 in tension and thereby clamp the leg 24, 26 to the adapter. The cover 66, if desired, is secured over the cavity to cover the openings 40, 54.

During assembly, or in assembling a kit (e.g., at the manufacturer or distributer), the installer or assembler selects one of the legs 24, 26 and corresponding fasteners 76, 38 and includes them in a kit for packaging and shipping, and/or selects them from inventor and couples the selected combination on the adapter. The kit, including the adapter, one or both legs and one or both fastener selections, may be assembled and used with fixed tables as well as the flip top table disclosed herein, or other types of structures supported by legs, including for example and without limitation, other types of furniture including body supporting structures, desks, and/or storage, or various types of machinery.

Figure 16A:
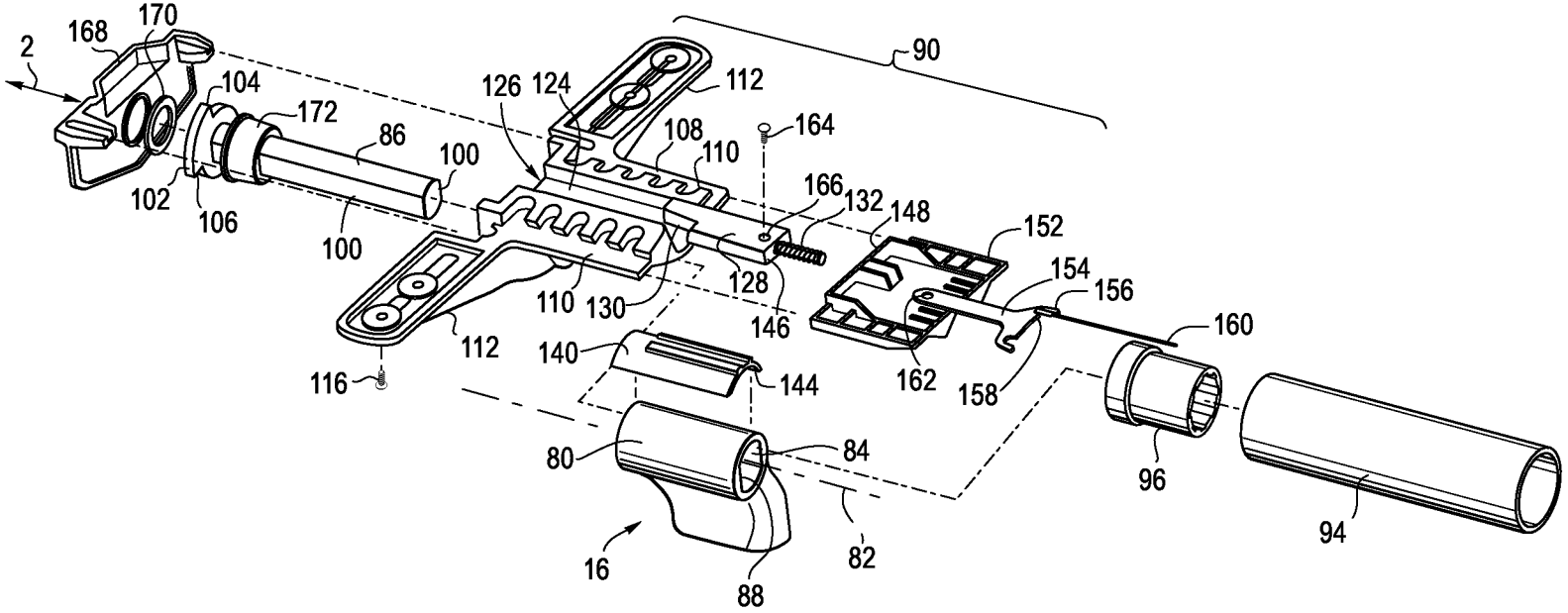
FIG. 16A is an exploded perspective view of a latch assembly.

Referring to FIG. 16A, the leg adapter further includes a lug 80 having a through opening 82 defining a longitudinally extending axis 84. The opening may be keyed, or have a cross-sectional shape, for example configured with a plurality of flats 88, which prevent rotation of an interfacing axle 86 as shown in FIGS. 16A and B. The axle may be made of steel, or other high-strength material. In one embodiment, the adapter is angled or curved, such that the lug 80 is not centered over the legs 18, 26. This configuration may enhance nesting, with the cover 66 engaging the adjacent worksurface.

Latch Mechanism

Referring to FIGS. 16A-18B, a latch mechanism includes a pair of subassemblies, a worksurface subassembly 90 coupled to a bottom of a worksurface 150, and a leg subassembly 92 coupled to the leg adapter 16. It should be understood that a support leg may be configured without a modular adapter, with the leg subassembly being coupled directly to the support leg.

Figure 16B:
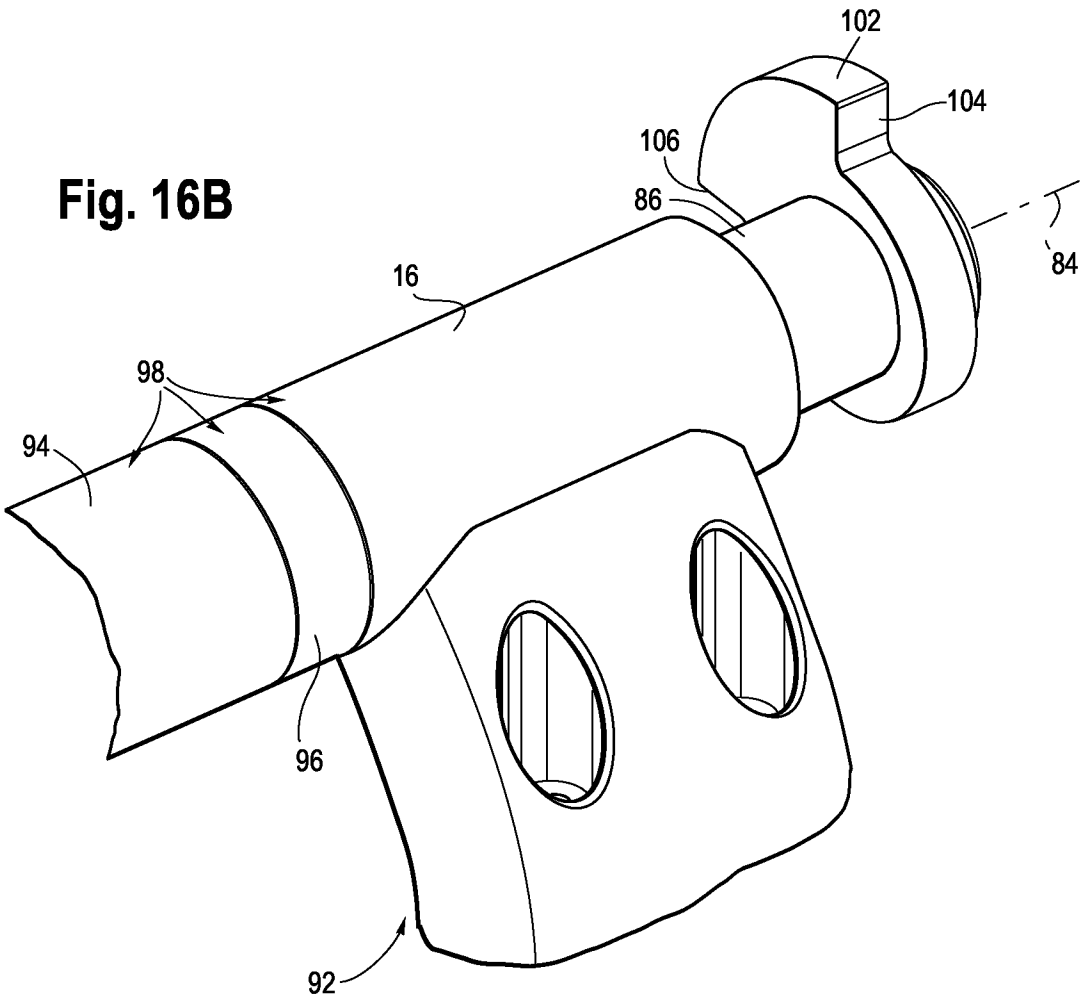
FIG. 16B is a partial view of the latch assembly shown in FIG. 16A.

The leg subassembly includes a cross bar 94, which extends longitudinally between and is non-rotatably fixed to longitudinally spaced first and second leg assemblies. The cross bar may be made of metal, such as steel or aluminum, for example as an extrusion. In one embodiment, a plug or chassis adapter 96 is fixed to the end of the cross bar, for example by welding. The plug or chassis may also be made of metal, such as steel. The cross bar 94, plug 96 and leg adapter 16 have outer surfaces 98 that are similarly dimensioned to provide a uniform, continuous surface therebetween as shown in FIG. 16B. The axle 86 extends through the leg adapter 16 and is fixed to the leg adapter and plug 96 with a key relationship, meaning the axle 86 has a cross-sectional shape with various flats 100 that mate with the flats 88 on the interior of the plug and leg adapter. In this way, the axle 86 is non-rotatably fixed relative to the support leg 24, 26 and cross bar 94. In one embodiment, the axle may be integrally formed with the leg adapter, for example as a casting.

A strike plate 102 is non-rotatably fixed to the end of the axle, meaning the strike plate does not rotate about the pivot axis 84. The strike plate 102 has first and second stop surfaces 104, 106 circumferentially spaced around, and extending radially from, the pivot axis 84, defined by the axle 86. The strike plate may be made of metal, such as steel.

Now referring to the worksurface assembly, a housing 108 has a pair of flanges 110 and laterally extending arms 112 that are secured to a bottom 114 of the worksurface 150 with fasteners 116. The housing may alternatively, or additionally, be secured with adhesives or other suitable devices. The axle 86 extends through a face 118 of the housing, which housing defines first and second stop surfaces 120, 122 circumferentially spaced around, and extending radially from, the pivot axis 84. The stop surface 120 of the housing engages the stop surface 106 of the strike plate 102 when the worksurface is rotated about the rotation axis to a use position, shown in FIGS. 1A and B. The housing may be made of metal, for example steel or an aluminum casting or machining, or hard plastic.

Figure 17B:
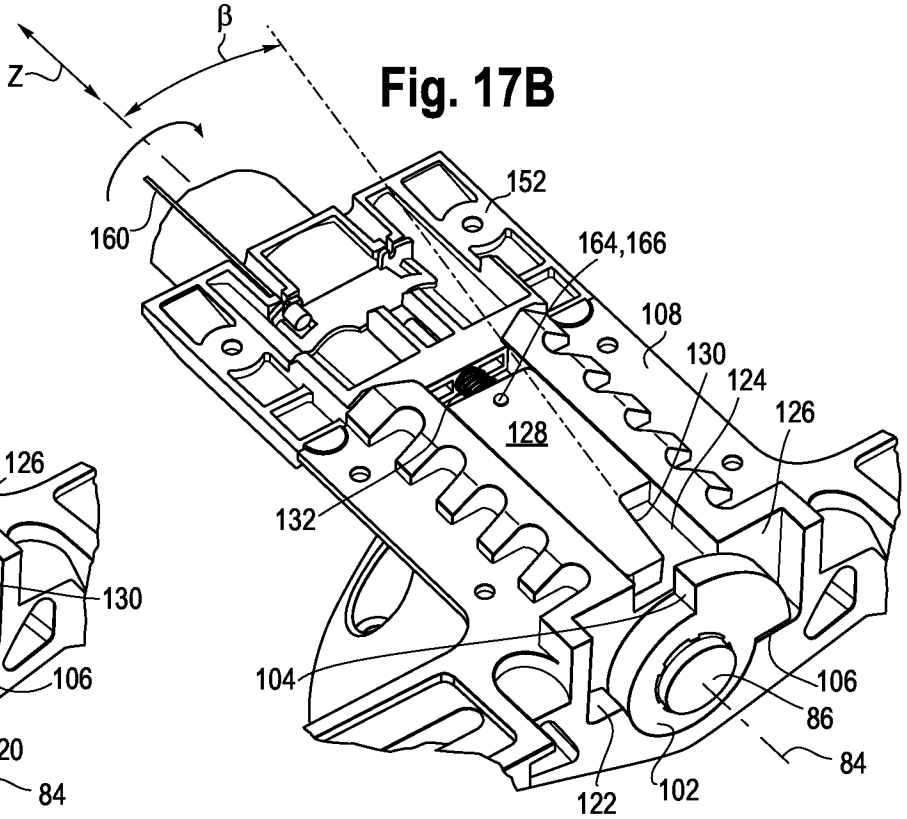
FIGS. 17A and B are partial perspective views of a latch assembly with a lock bolt in an engaged and disengaged position.
Figure 17A:
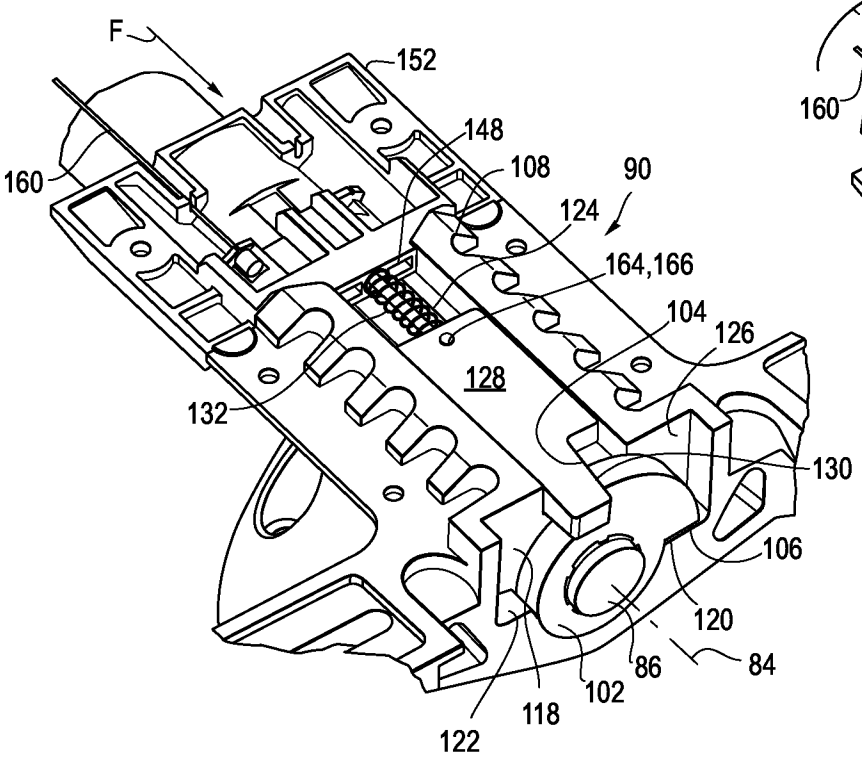

Referring to FIGS. 17A and B, the housing 108 includes a longitudinal track 124 opening into a cavity 126 defining the first and second stop surfaces 120, 122. A lock bolt 128 is disposed in the track 124 and is moveable in the longitudinal direction 2 between a disengaged position and an engaged position. The lock bolt may be made of metal, for example steel. In one embodiment, the lock bolt includes a latch surface 130 tapered at an angle β in the longitudinal direction 2, with the tapered surface tightening against the stop surface 104 as the lock bolt 128 moves into the cavity 126 along the longitudinal direction. The latch surface 130 engages the stop surface 104 of the strike plate 102 when the lock bolt is moved into the cavity 126 in the engaged position and the worksurface is in the use position. The tapered configuration of the latch surface, together with the biasing force F of a biasing member 132, ensures that the lock bolt 128 maintains maximum engagement with the strike plate 102 over time and repeated use of the system as the surfaces 130, 104 wear, or tolerances are built up. When the lock bolt 128 is in the disengaged position (FIG. 17B), the worksurface 150 may be rotated or pivoted about the pivot axis 84 to a stowed position (FIG. 2). In this position, the stop surface 122 on the housing engages the stop surface 104 on the strike plate 102.

Figure 18A:
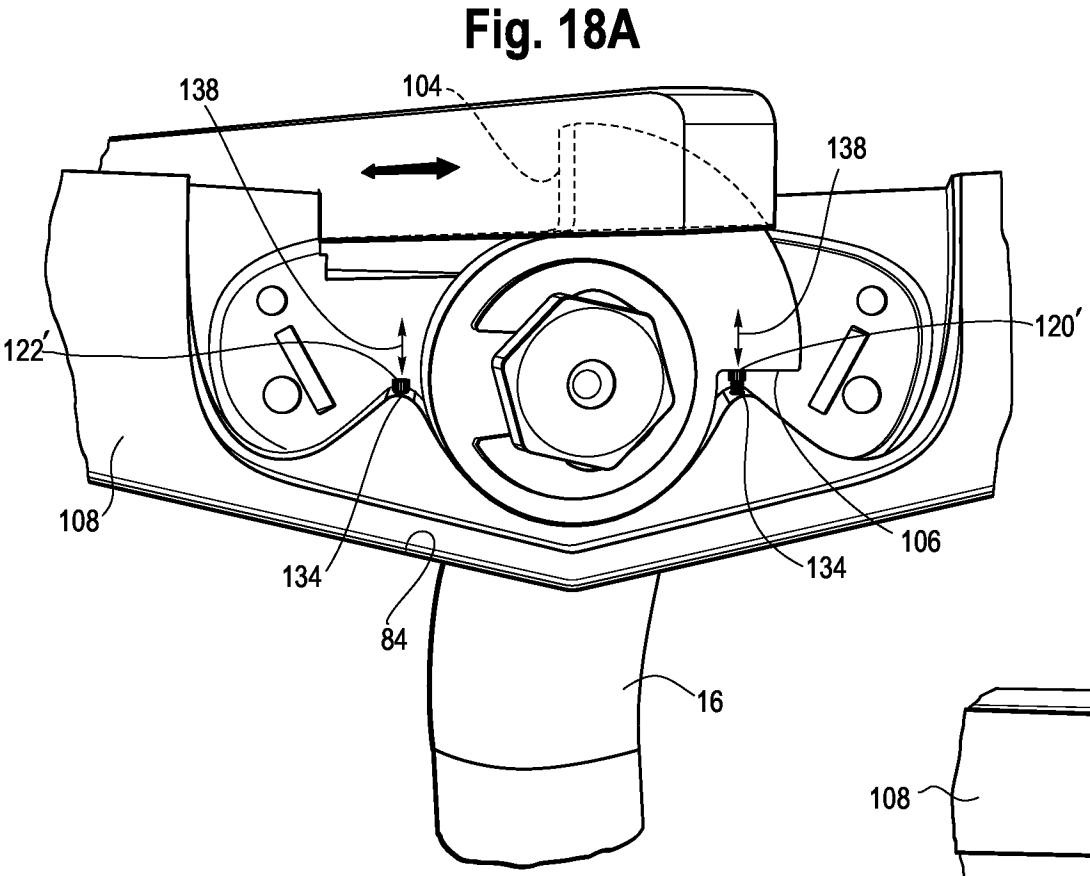
FIGS. 18A-C are partial views showing adjustable stop surfaces, with FIGS. 18A and C showing opposite leg assemblies (right and left) in use and stowed positions respectively.
Figure 18B:
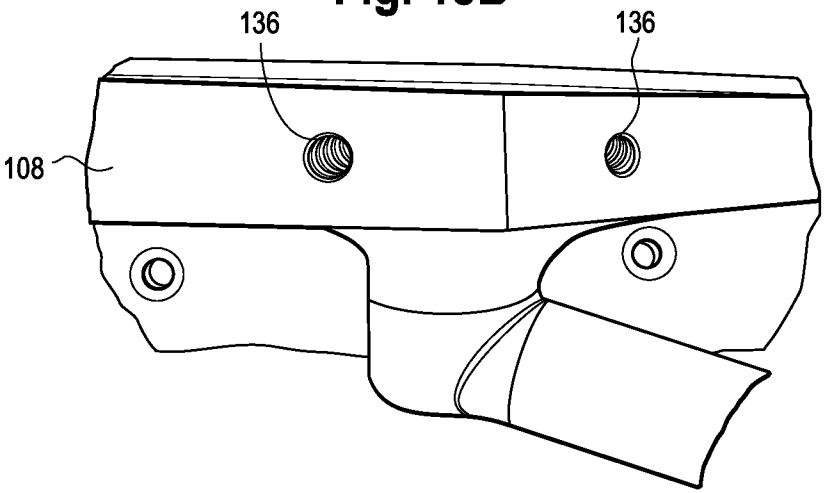

Referring to FIGS. 18A and B, the stop surfaces 120', 122' on the housing may be circumferentially adjustable relative to the rotation axis 84. For example, a pair of set screws 134 may extend through openings 136 in the housing 108. The screws may be rotated so as to lengthen or shorten an exposed end portion in a tangential direction 138, with the ends of the screws 134 defining the stop surfaces 120', 122'. In this way, the screws may be adjusted to level the worksurface in the use position.

Referring to FIGS. 16A-17B, 26A, B and 27, a skid plate 140, made for example of plastic, is coupled to the bottom of the housing 108 and has a curved bottom surface 144 that bears against, and rotatably slides along, an upper surface 142 of the leg adapter lug 80. The biasing member 132, such as a compression spring, is disposed between a bearing surface 146 of the lock bolt 128 and a bearing surface 148 defined by an end cap 152 coupled to the housing. The biasing member 132 biases the lock bolt in the longitudinal direction 2 toward an engaged position with the strike plate.

The end cap 152 is positioned at an inner end of the housing. The end cap also has a curved bottom surface 153 that mates with the outer surface of the cross bar 94. An actuator plate 154, or strap, is slidably supported by the end cap 152. The plate 154 includes an arm portion 156 having an end that engages an end 158 of a cable 160, which slides in a cable housing 356. The plate is translatable in the longitudinal direction 2. An opposite end 162 of the plate is coupled to the lock bolt, for example at opening 166 with a pin 164 or PEM stud.

Figure 30:
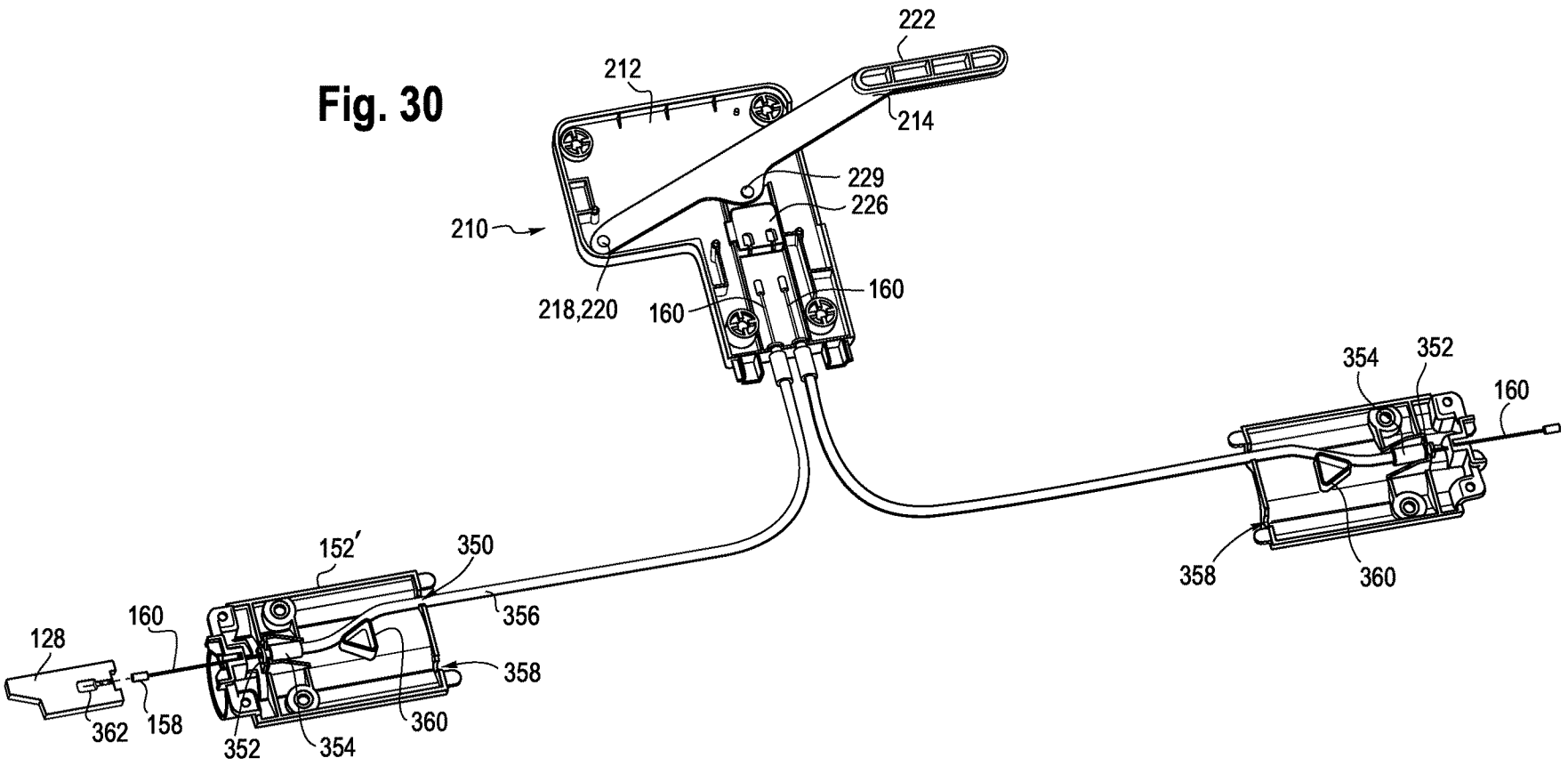
FIG. 30 is an interior view of an actuator.
Figure 31:
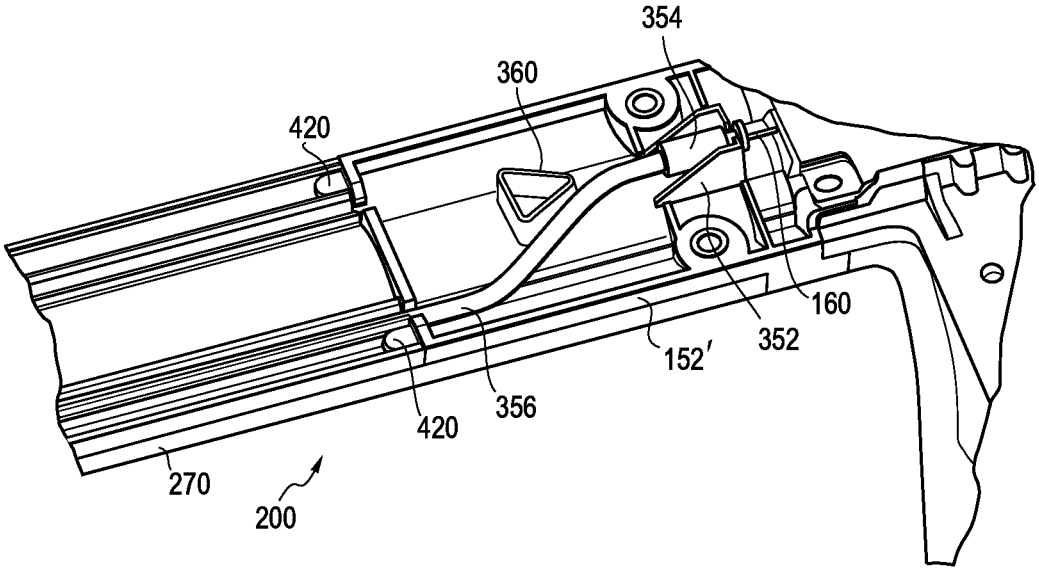
FIG. 31 is a partial top view of a shroud and cable assembly showing a connection between a linear section and an end section of the shroud assembly.

In an alternative embodiment, shown in FIGS. 30 and 31, the actuator plate is omitted, with the end cap 152' having a stop 352 engaging an end portion 354 of a cable housing 356. The end cap has a pair of entry openings 358 and a two-sided guide 360, shaped like a triangle, such that the end cap can route the cable from either opening, depending on which side of the worksurface the end cap is installed. In this embodiment, the end 158 of the cable is coupled directly to the lock bolt 128, for example by inserting the end through an opening 362 formed in the lock bolt. The end cap may be made of metal or plastic.

A cover 168 is secured over and covers the strike plate 102. A bushing 170 is disposed between the cover and the end of the axle 86 to support the axle on the cover. In addition, a bushing 172 is non-rotatably disposed over an intermediate portion of the axle, with the housing 108 rotating about the bushing and axis. The cover may be made of metal or plastic. The cover, end cap, skid plate and housing eliminate any pinch points between the leg assembly, worksurface and cross bar, and also eliminate or avoid any pinch points created by the lock bolt and strike plate.

Referring to another embodiment of a latch mechanism, shown in FIGS. 19-22, the latch assembly again includes two subassemblies, one coupled to a worksurface and the other coupled to a leg or support member. One of the subassemblies includes a stop member 174, otherwise referred to as a blade component or cam, having an engagement surface 176 and a circumferentially spaced hook member 178. The other subassembly includes a lock member 180 (otherwise referred to as a lock bolt), configured as a cantilever or leaf spring. The subassemblies are pivotally connected with a pivot member 182, and are pivotable between a locked position, where an end 184 of the lock member is biased against an engagement surface 176 of the stop member (FIG. 20B), and an unlocked position, where an end 184 of the lock member 180 slides along a periphery of the stop member.

Figure 20B:
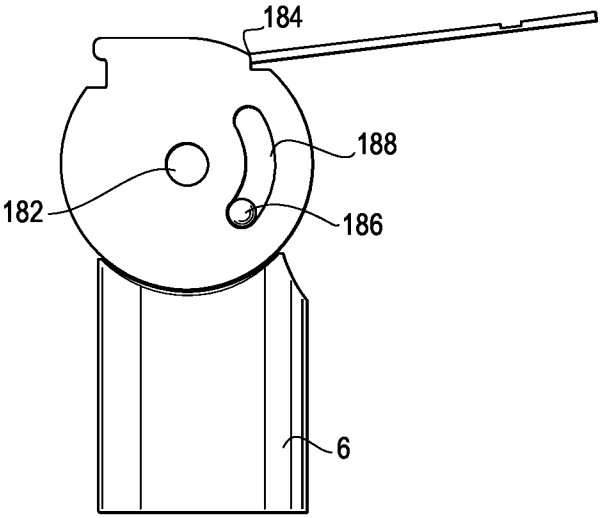
FIGS. 20A and B show a latch member from the embodiment of FIG. 19 in an unlocked and locked position.
Figure 20A:
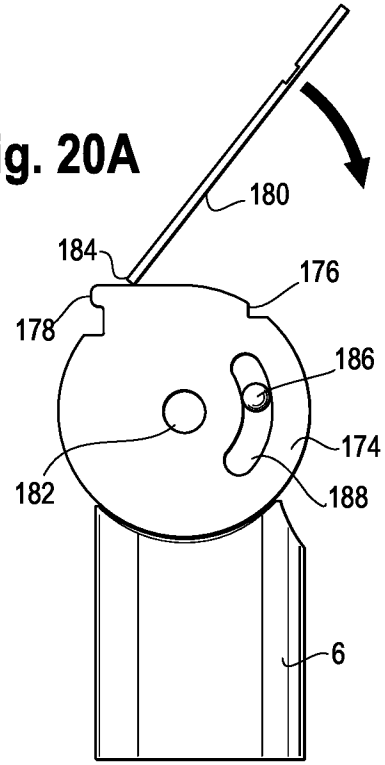
Figure 22:
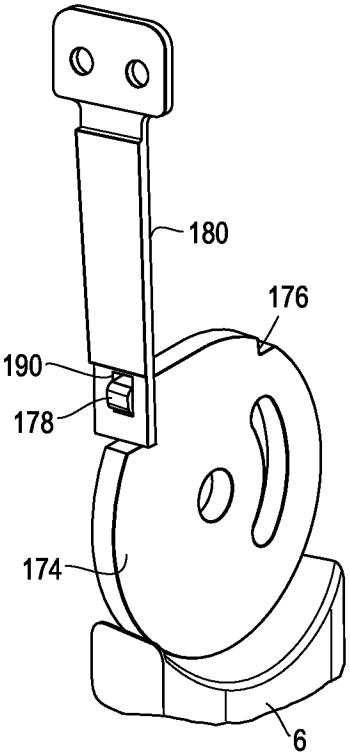
FIG. 22 shows the latch member in the secondary locked position.
Figure 21B:
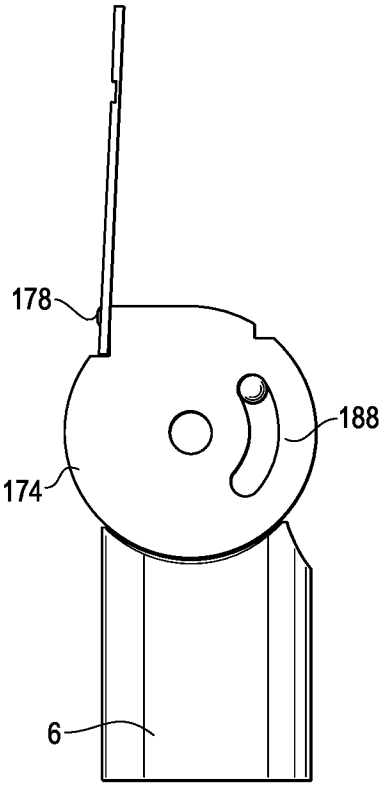
FIGS. 21A and B show a latch member from the embodiment of FIG. 19 in an unlocked and secondary locked position.
Figure 21A:
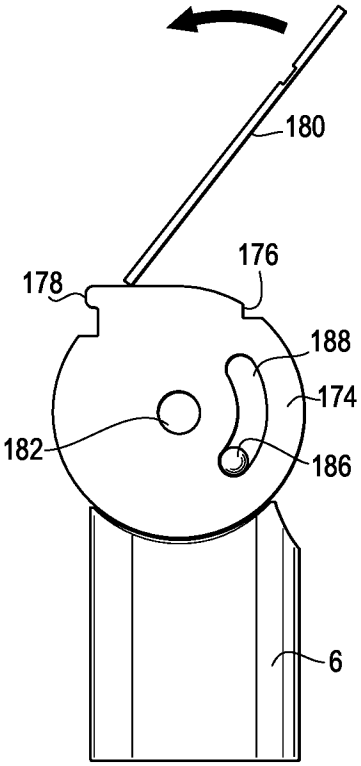

The end 184 of the lock member and the engagement surface 176 are each configured with a tapered surface, so as to maintain a tight engagement even if worn, as well as to define a load path therebetween. A hard stop 186, configured as a pin moving within a slot 188 in one embodiment, limits movement of the two components in either pivot direction. The lock member 180, through the engagement surface, applies a continuous load against the hard stop as shown in FIG. 20B, thereby providing a more rigid table.

When the lock member 180 is released from the locked position, e.g., by bending, the lock member slides along the peripheral edge of the stop member until an opening 190 or notch in the spring is engaged by the hook member 178 formed on the stop member. The hook member 178 engages the opening 190 to hold the lock member, and associated work surface, in a stored position.

The latch mechanism, including the lock member, may be contained within a housing 192, which envelops the stop member, thereby reducing and/or eliminating pinch points and potential tampering. The housing and latch mechanism are relatively compact and easily assembled.

Figure 23:
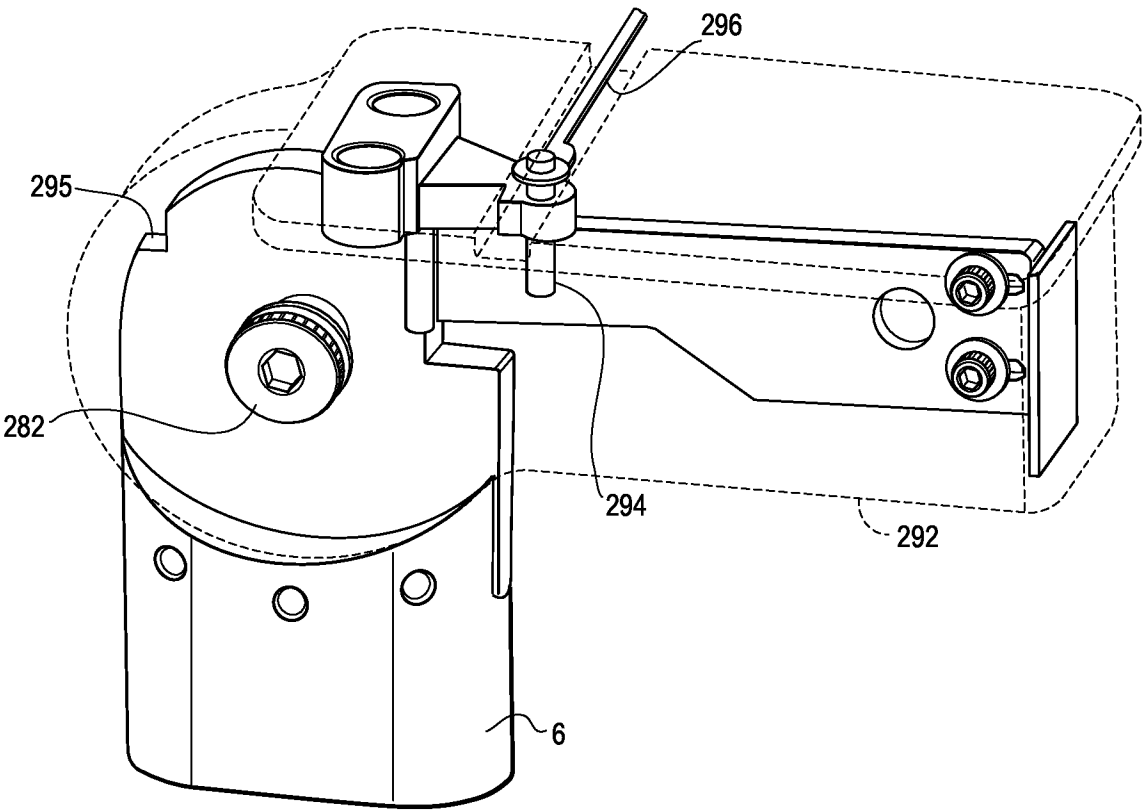
FIG. 23 is a perspective view of an alternative embodiment of a latch assembly.
Figure 24B:
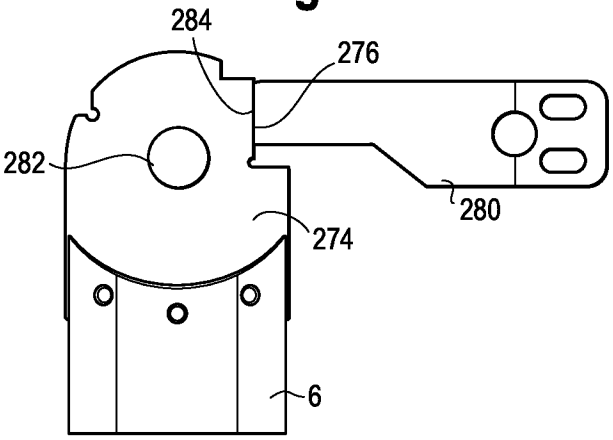
FIGS. 24A and B are side views of a latch member in a locked and unlocked position.
Figure 25:
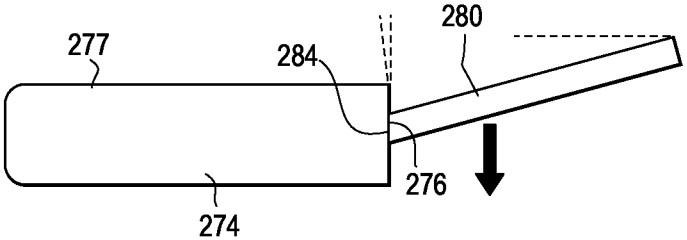
FIG. 25 is a top view of the latch member in a locked position.
Figure 24A:
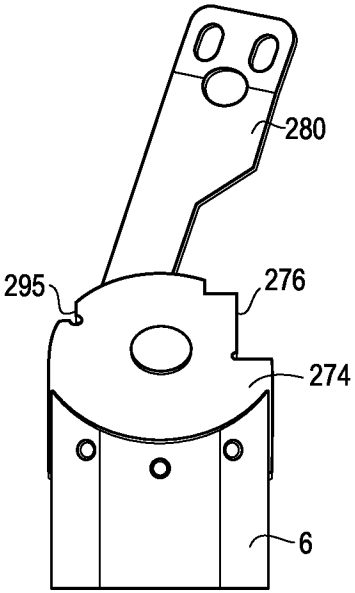
Figure 26B:
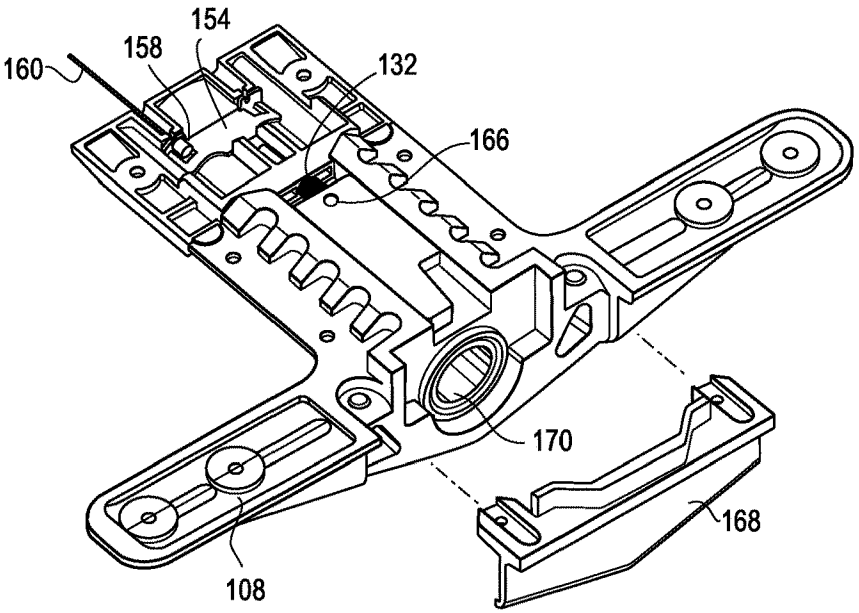
FIGS. 26A and B are bottom and top perspective views of one embodiment of a worksurface subassembly.
Figure 26A:
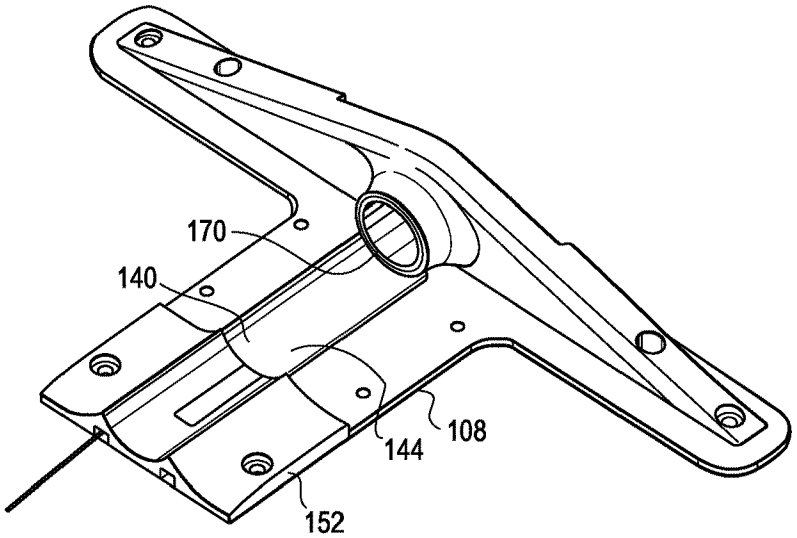

Referring to another embodiment of a latch mechanism shown in FIGS. 23-25, one of the subassemblies includes a stop member 274, otherwise referred to as a blade component, having an engagement surface 276. The other subassembly includes a lock member 280, configured as a cantilever or leaf spring. The subassemblies are pivotally connected with a pivot member 282, and are pivotable between a locked "use" position, where an end 284 of the lock member is biased into engagement with the engagement surface 276 of the stop member, and an unlocked position, where the lock member slides along the side 277 of the stop member.

The end 284 of the lock member and the surface 276 are each configured with a tapered surface, so as to maintain a tight engagement even if worn, as well as to define a load path therebetween. The lock member is contained within a housing 292, which envelops the stop member, thereby reducing and/or eliminating pinch points and potential tampering. The housing and lock member are relatively compact and easily assembled. A release/blocker 294 is used to actuate the lock member, as well as provide a secondary lock. The blocker is actuated by an actuator 296, such as a cable or rod, which passes through a recess 298 formed in the top of the housing. The release, when actuated, bends or presses the lock member out of engagement. The blocker 294 also engages a detent 295 in the stop member to lock the worksurface in an upright, stored position.

User Interface

Figure 6:
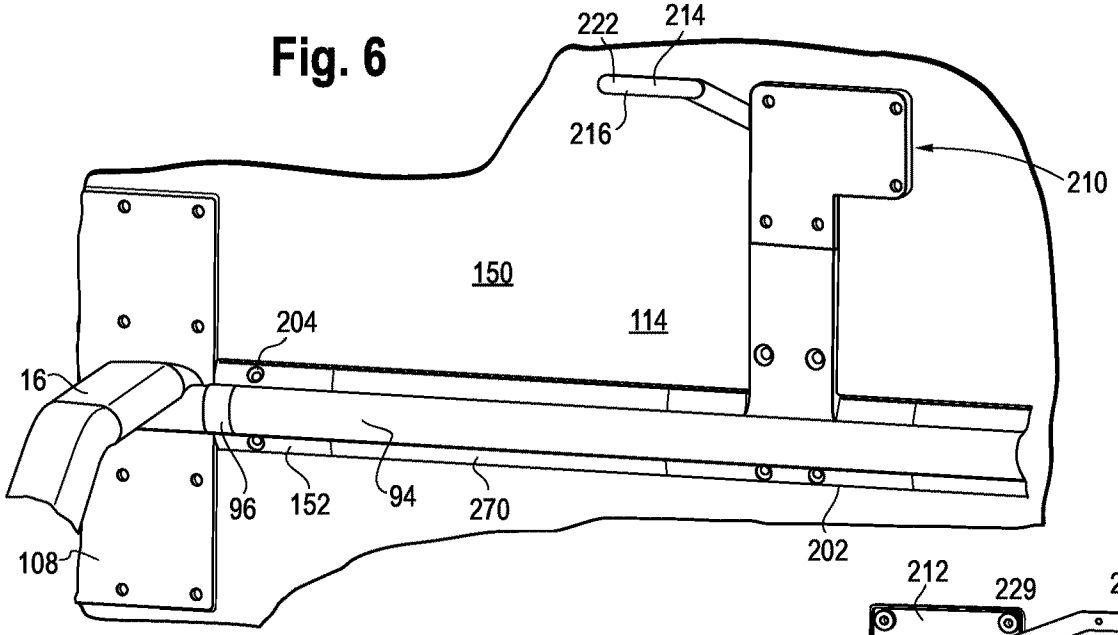
FIG. 6 is an enlarged partial view of an actuator coupled to a bottom of a worksurface.
Figure 7:
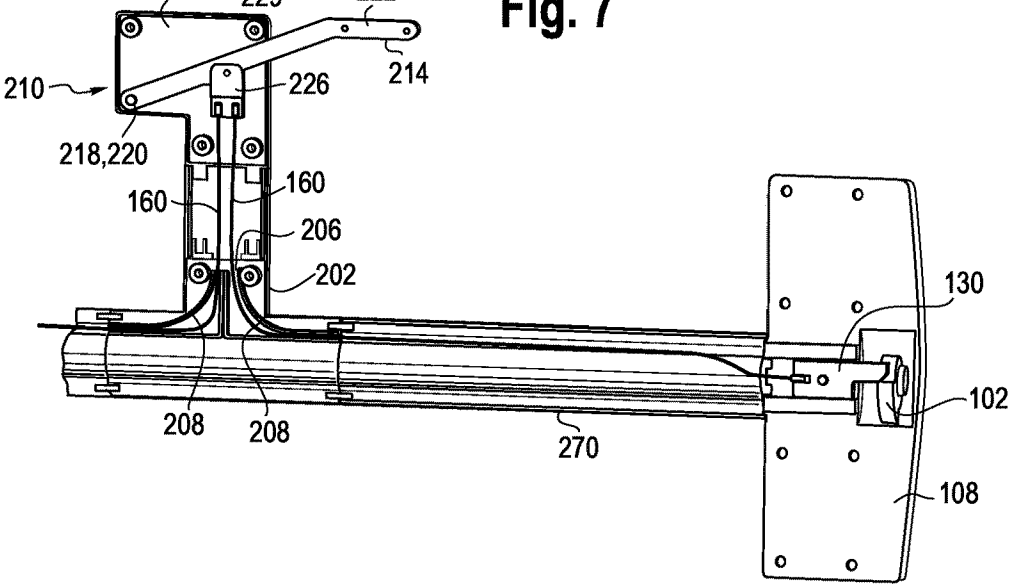
FIG. 7 is an enlarged partial interior view of an actuator coupled to a bottom of a worksurface.

Referring to FIGS. 6, 7 and 30, the cable 160 from each latch assembly extends longitudinally within a shroud 200 that is coupled to the bottom of the worksurface, for example with fasteners 204, tabs (e.g., snap fit), adhesive or combinations thereof. The shroud may include a linear section 270, made as an extruded rail, for example of metal or plastic. The shroud 200 extends between the first and second leg assemblies, abutting and matting with the spaced apart end caps 152, and at least partially encircles the cross bar 94. In this way, the pinch points between the cross bar 94 and worksurface 150 are eliminated. In addition, the shroud 200 covers and protects the cables 160. An intermediate section 202 of the shroud has a T-shape, with an outlet 206 extending laterally. A pair of curved cable guides 208 are formed interiorly of the intermediate section. A user interface 210 is coupled to the outlet of the intermediate section.

Referring to FIGS. 31-35, in one embodiment, the cables are disposed in tubular cable housings 356, each having a pair of end portions 354. The cable housing end portions 354 are fixedly secured in the user interface housing (or intermediate section) and the end cap/section, as shown in FIGS. 30 and 31, with the cable 160 moving back and forth in the stationary housing 356. In this way, the cables 160 extend between the user interface and the latching mechanisms, where the cable is coupled to the lock bolt 128. The cable housings 356, and cables 160, are disposed in the shroud 200, which is secured to a bottom of the worksurface.

Figure 32:
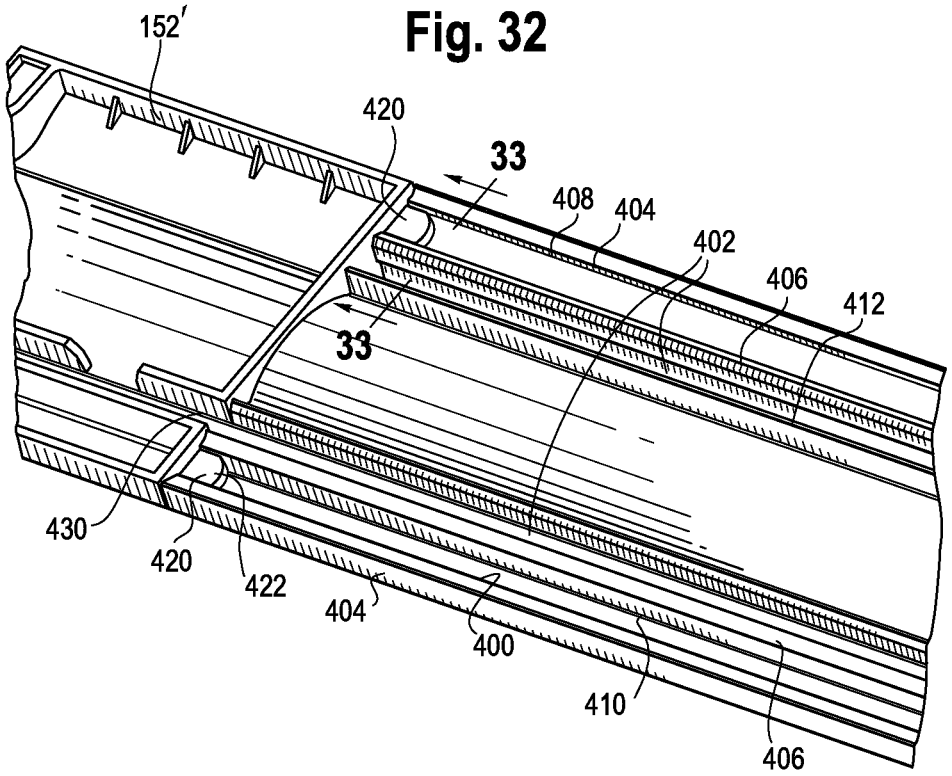
FIG. 32 is a partial top view of a shroud assembly showing a connection between an intermediate T-shape section and a linear section.
Figure 33:
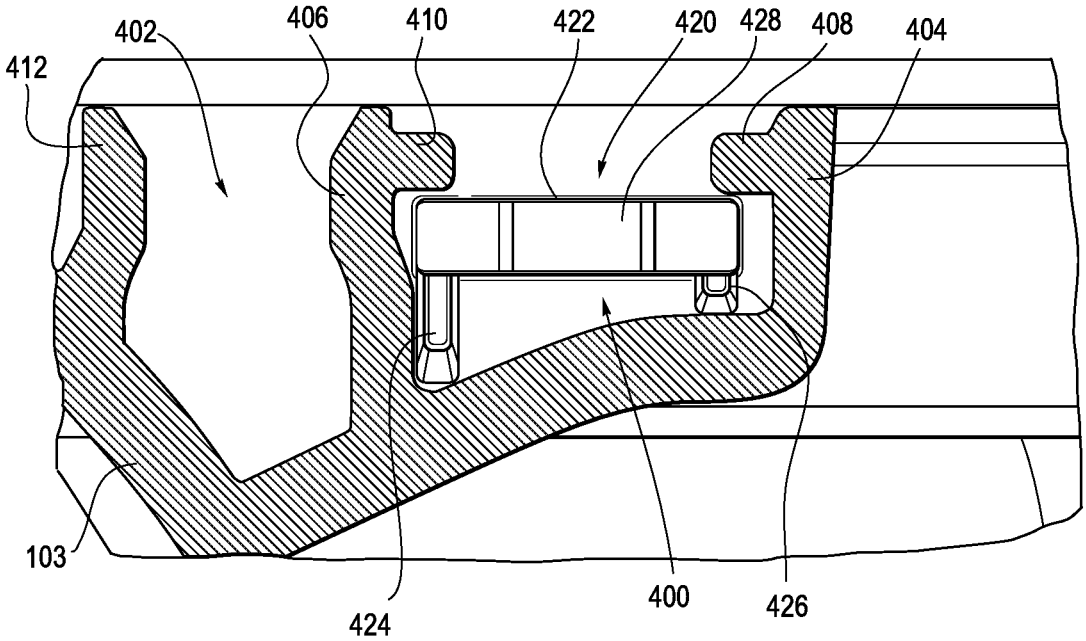
FIG. 33 is a partial cross-sectional view of the interface between the intermediate section and the linear section taken along line 33-33 of FIG. 32.
Figure 34:
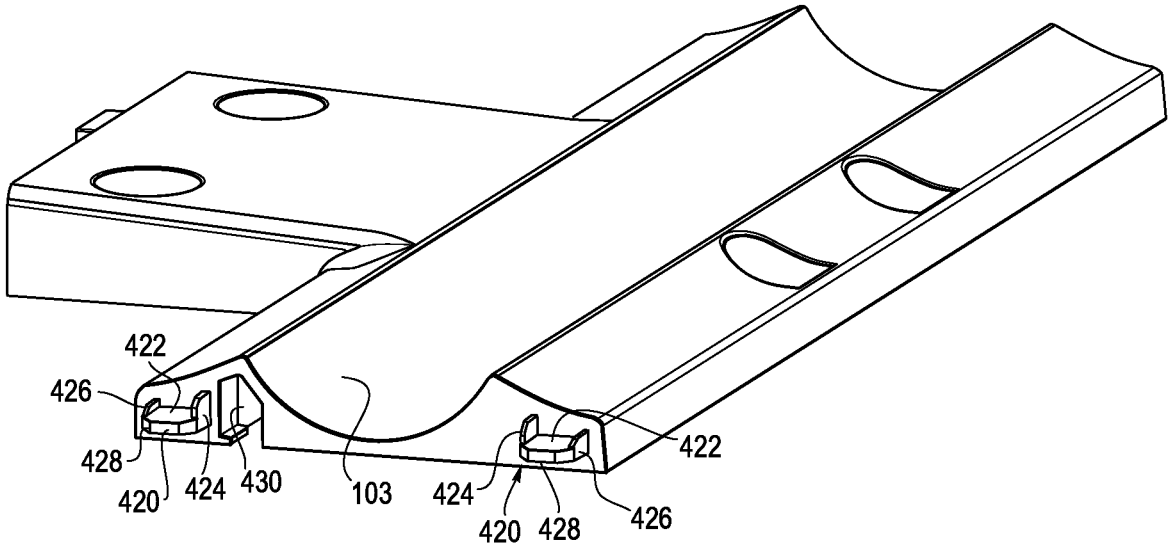
FIG. 34 is a partial, perspective view of the intermediate T-shape section.
Figure 35:
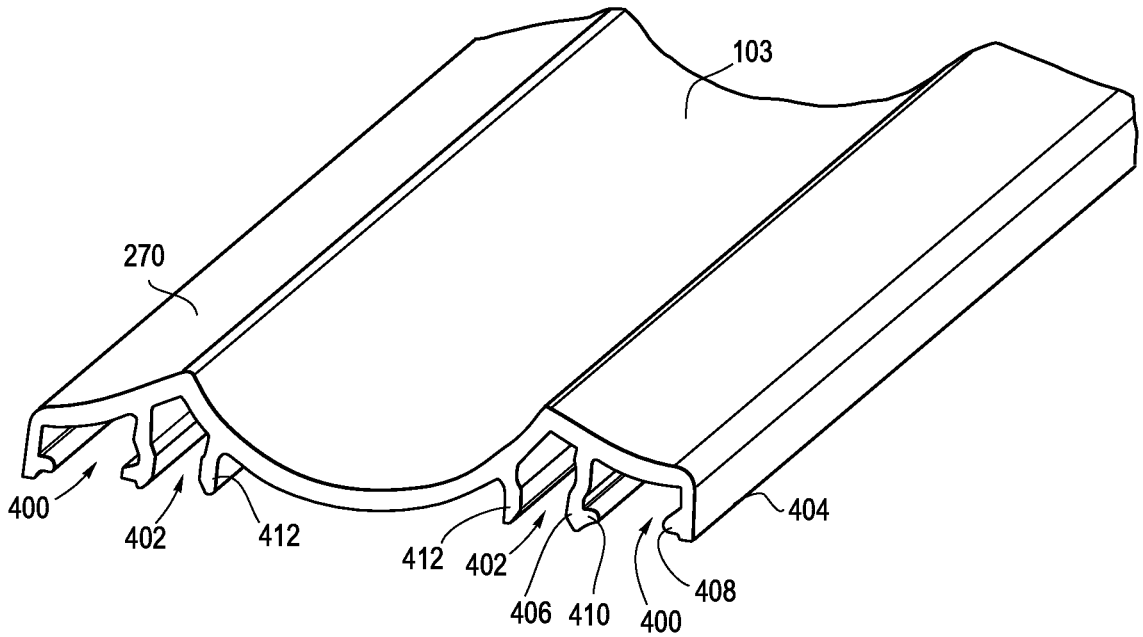
FIG. 35 is a partial, perspective view of the linear section.

In the embodiment shown in FIGS. 31-35, the shroud 200 includes an intermediate T-shaped section 202 coupled to opposite pairs of linear sections 270, which are connected in turn to end caps/sections 152' that transition the cables to the latch mechanism. Referring to FIGS. 33 and 35, the linear sections 270 are made from an extrusion having a pair of interface channels 400 running along the outer/opposite sides of the extrusion, and a pair of cable channels 402 positioned inboard of the interface channels. Each interface channel 400 is defined by an outermost flange 404 and an interior flange 406, each configured with an inwardly turned lip 408, 410, or ridge. The cable channel 402 is sized to accommodate and hold the cable guide, with an interior flange 412 flexing to engage and hold the housing in an enlarged uppermost portion of the channel.

Referring to FIGS. 31-34, the T-shape intermediate section 202 and the end sections 152' are each configured with a pair of tabs 420, which are spaced apart and shaped to be received and inserted into the channels 400 at the opposite ends of the linear section. The tabs 420 have a flange portion 422 and a pair of side walls 424, 426 extending from the flange portion. In one embodiment, the flange portion has a horizontal orientation, with the side walls extending upwardly from the flange portion in an orthogonal relationship. It should be understood that the side walls may form an angle relative to the flange portion, may extend upwardly from the flange portion, and/or that the flange portion may have a non-horizontal orientation. The free ends 428 of the tabs are chamfered to ease insertion into the channels 400.

The side walls 424, 426 provide a transition fit, which vertically aligns each of the intermediate section 202 and/or end sections 152' at four locations at each interface with the linear section 270, as the upper surface of the horizontal portion 422 is engaged by the lips 408, 410 as shown in FIG. 33. In this way, the flange and side walls engage the channel at spaced apart locations.

The ends of the intermediate section and end sections each have a single channel opening 430 through an end wall, as shown for example in FIGS. 32 and 34. The opening 430 is aligned with one of the cable channels 402 of the linear section 270, thereby allowing the cable housing 356 to pass through the aligned openings as shown in FIGS. 31, 32 and 34. The end sections 152' then transitions the cables to a central axis of the end sections, as shown in FIGS. 30 and 31. In this way, the end sections are "handed" in one embodiment while the linear section is symmetrical, but with each end section routing the cable from a different channel in the left and right linear sections to a central axis. Of course, it should be understood that the end sections may be made with a pair of openings.

Figure 28:
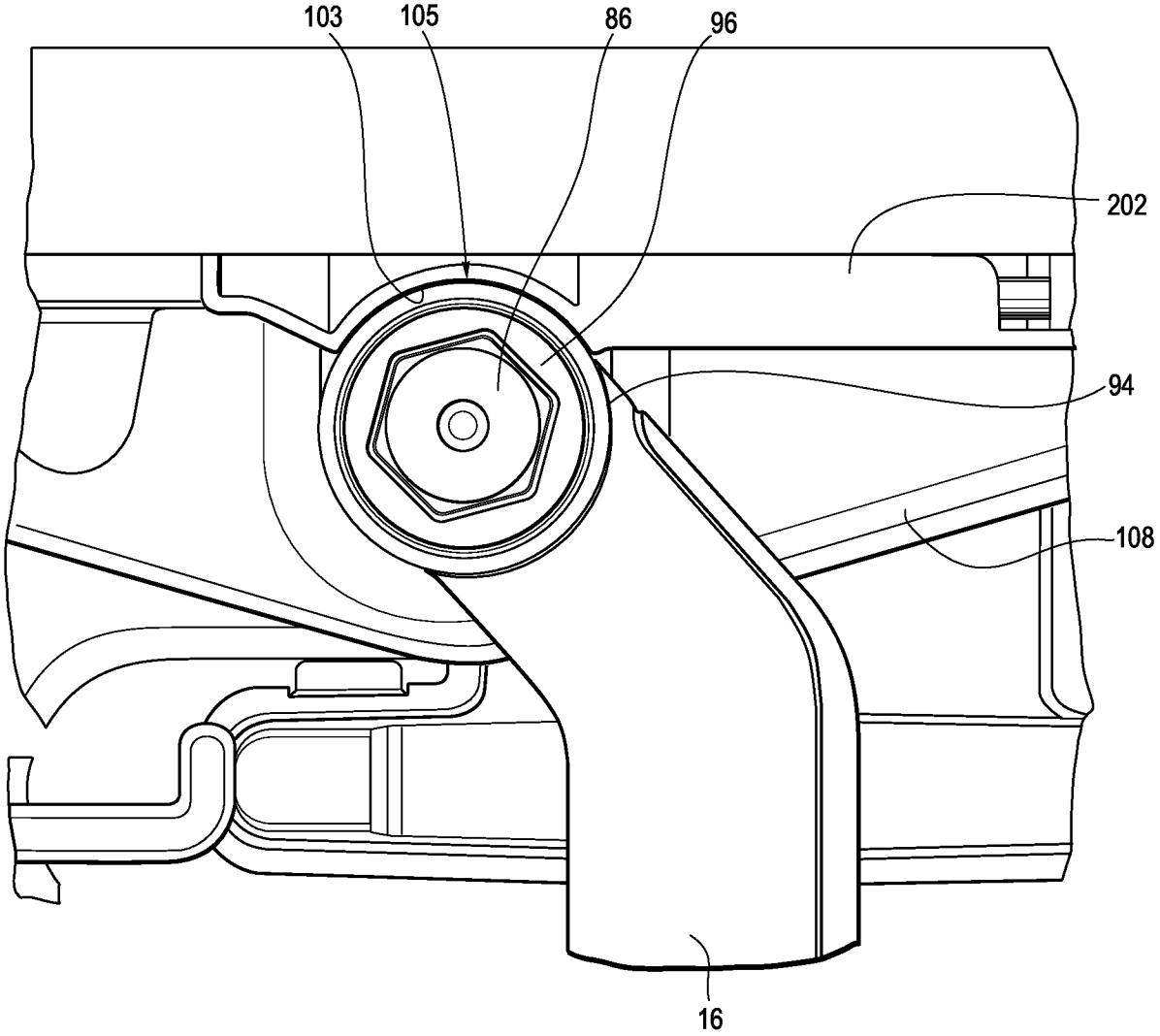
FIG. 28 is a cross-sectional view of the cross bar, shroud, axle and leg assembly.

In one embodiment shown in FIGS. 28, 34 and 35, the shroud, which has a curved surface 103 interfacing with an outer surface 105 of the cross bar bears against the cross bar to transfer the load between the worksurface and the cross bar. In this way, the worksurface is provided with additional support when loaded, and transfer the load to the cross bar rather than carrying the entire load to the housings 108 through bending.

The user interface includes a housing 212 secured to the bottom of the worksurface, for example with fasteners 204. A lever 214, having a grippable cover 216 on at least one side, is pivotally mounted to the housing about a first axis 218 with a pivot member 330, such as a pin. A handle portion 222 of the lever extends outwardly from the housing, where it can be grasped by a user.

Figure 8C:
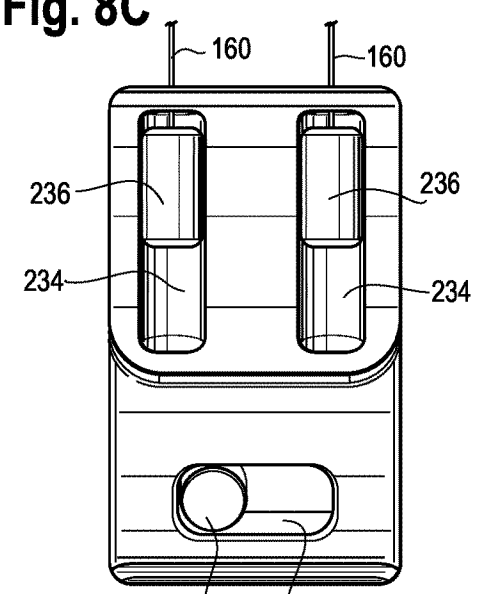
FIG. 8C is a bottom view of a slider shown in FIGS. 8A and B.

A slider 226 is pivotally secured to the lever with a pin about a second axis 229 spaced apart from the first axis 218 and positioned between the handle portion 222 and the first axis 218 so as to maximize the leverage applied by the user. The slider 226 is linearly movable within a longitudinal track 228 defined by the housing. The slider includes an elongated slot 230, or cam surface, extending laterally. A pivot pin 232, defining the second axis, extends through the slot and couples the slider to the lever. The slider includes a pair of couplers 237 engaging the ends of the cables 236. In one embodiment, shown in FIG. 8C, the slider 226 includes a pair of tracks 234. The ends 236 of the cable 160, configured in one embodiment as barrels, are disposed in the tracks 234 and are moveable therein. The lever and slider may be made of metal or plastic.

Figure 1A:
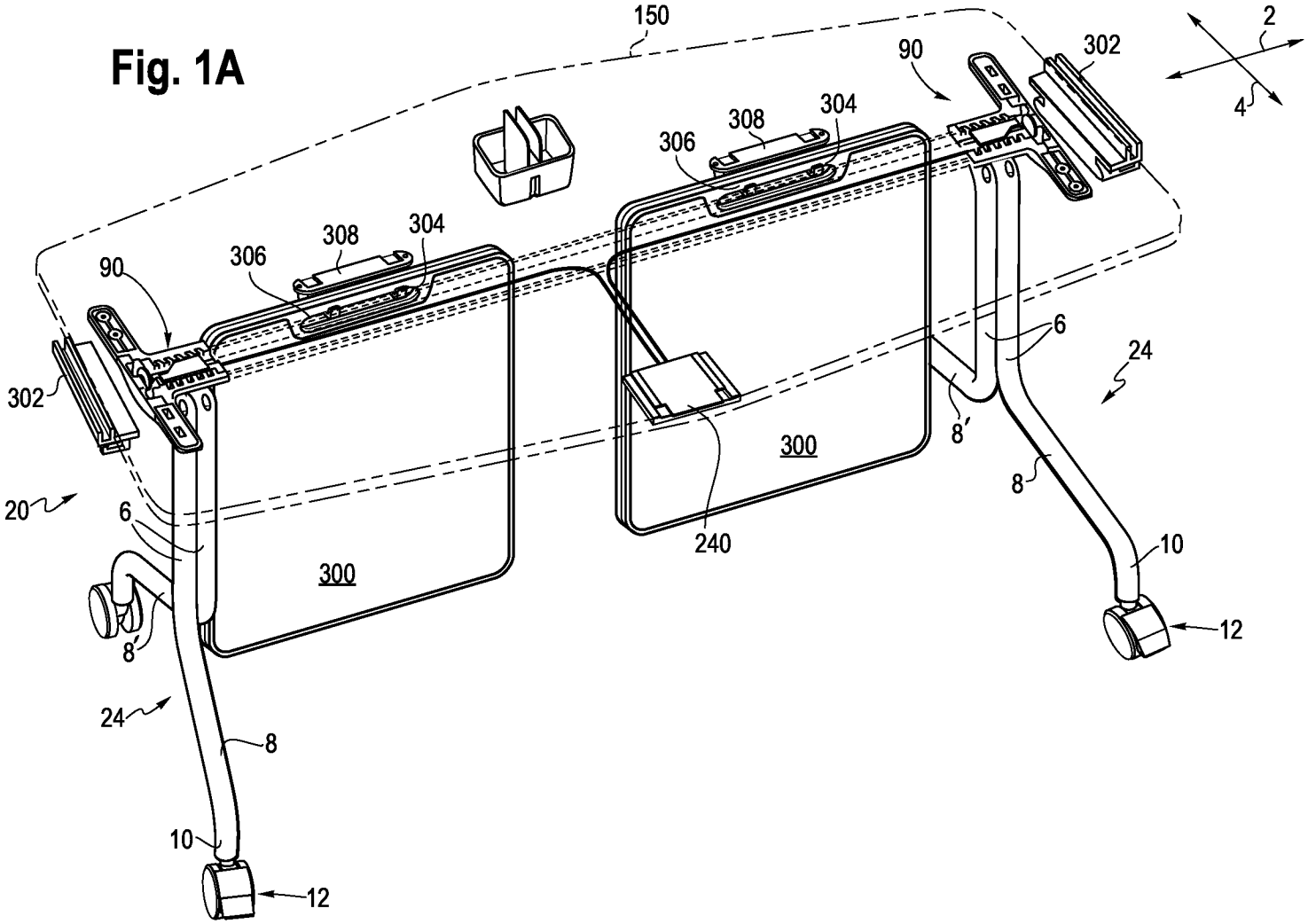
FIG. 1A is a perspective view of one embodiment of a flip top table with white boards in a stored position and a worksurface in a use position.
Figure 1B:
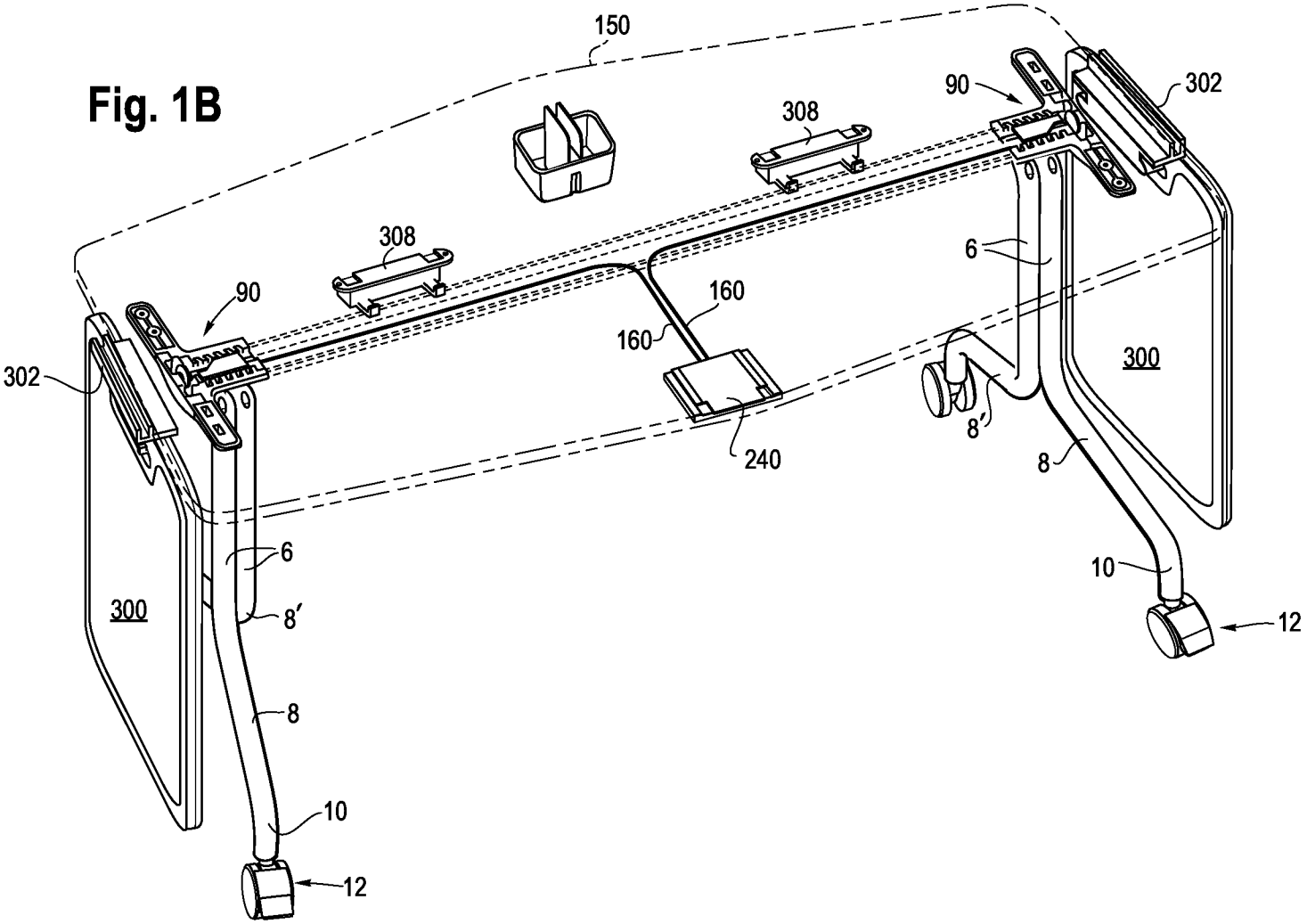
FIG. 1B is a perspective view of one embodiment of the flip top table shown in FIG. 1A with the white boards in a display or auxiliary stowed position.
Figure 2:
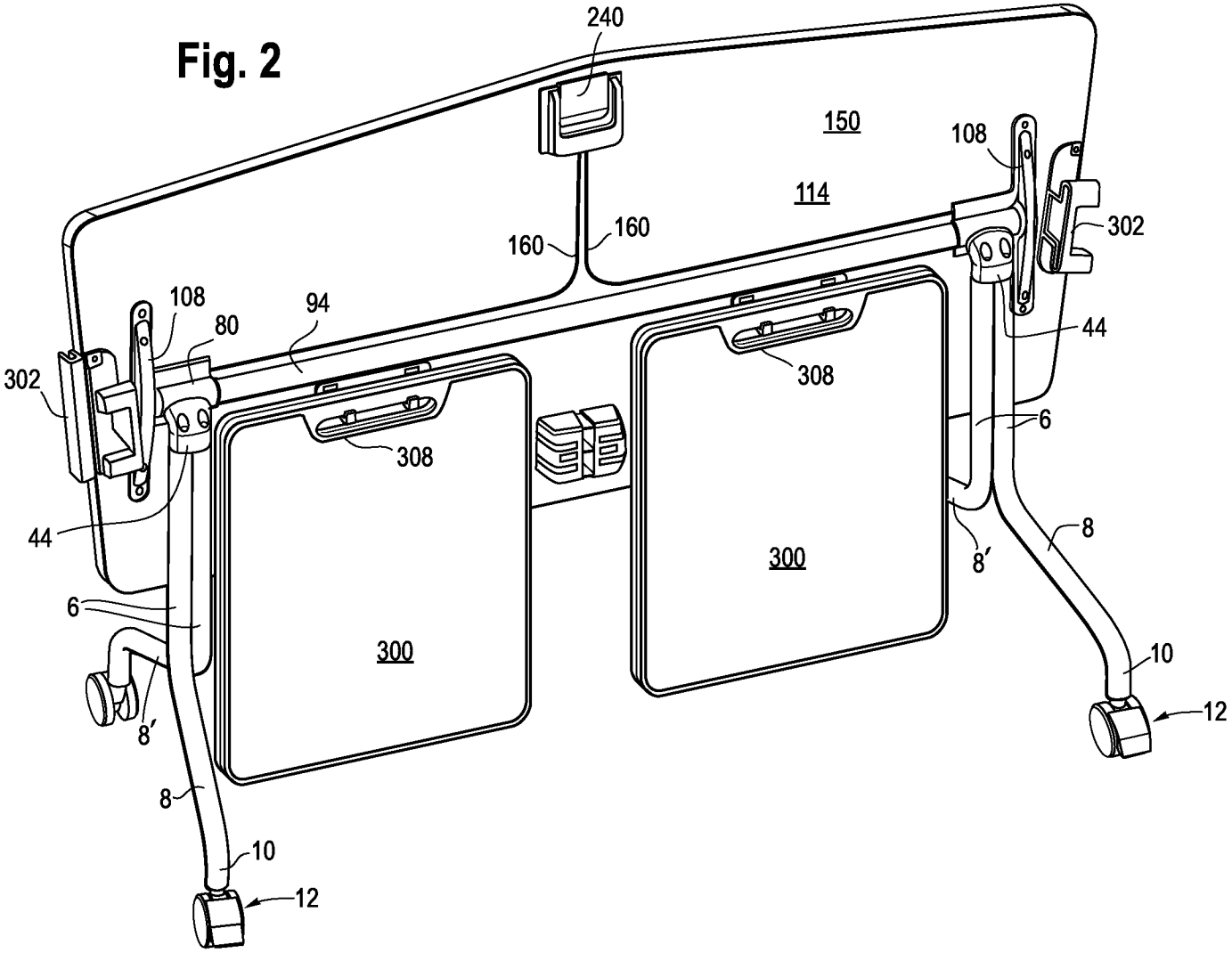
FIG. 2 is a perspective view of one embodiment of a flip top table with a worksurface in a stowed position.
Figure 3:
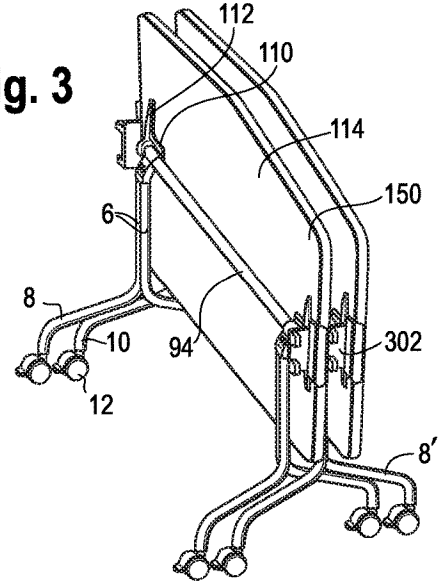
FIG. 3 is a perspective view of a pair of flip top tables in a nested configuration.
Figure 4:
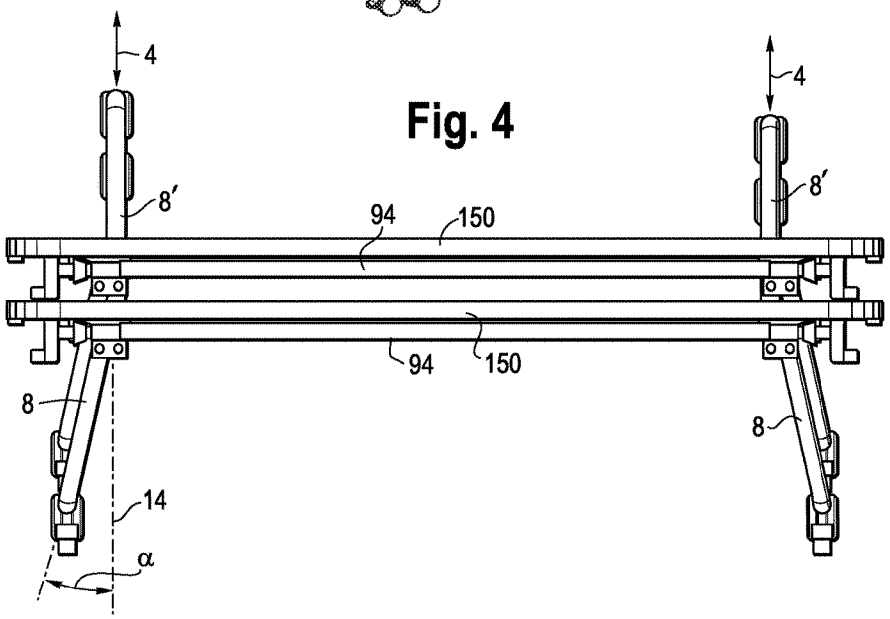
FIG. 4 is a top view of the flip top tables shown in FIG. 3.
Figure 5:
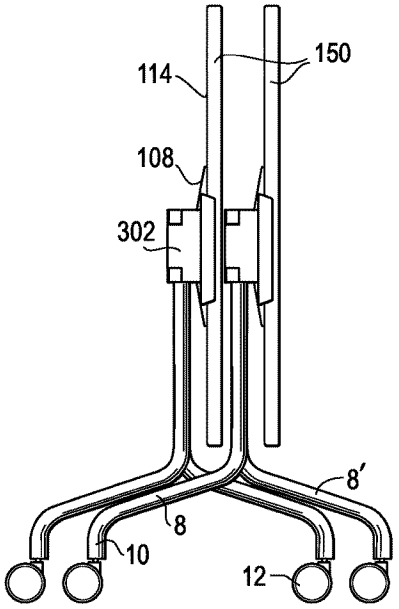
FIG. 5 is an end view of the flip top tables shown in FIG. 3.

In an alternative embodiment, shown in FIGS. 1A-2, the user interface includes a linear handle 240 that may be grasped and moved in and out, with the ends of the handle connected directly to the cables.

Operation:

Referring to FIGS. 1A and B and 18A (showing right side), a worksurface 150 is shown in a substantially horizontal use position, with the outline of the worksurface shown in phantom for the sake of clarity and visibility of the underlying latch mechanism and use interface. It should be understood that the worksurface may have other orientations defining a use position. In this position, as noted above, one of the stop surfaces 120, 120' of the worksurface housing (or set screw) on each end of the table is engaged with a stop surface 106 of the strike member. In addition, the latch surface 130 of the lock bolt 128 is engaged with the other stop surface 104 of the strike plate 102. Or in other embodiments the end portion 184, 284 is engaged with surface 176, 276 as shown in FIGS. 20B and 25.

Figure 8B:
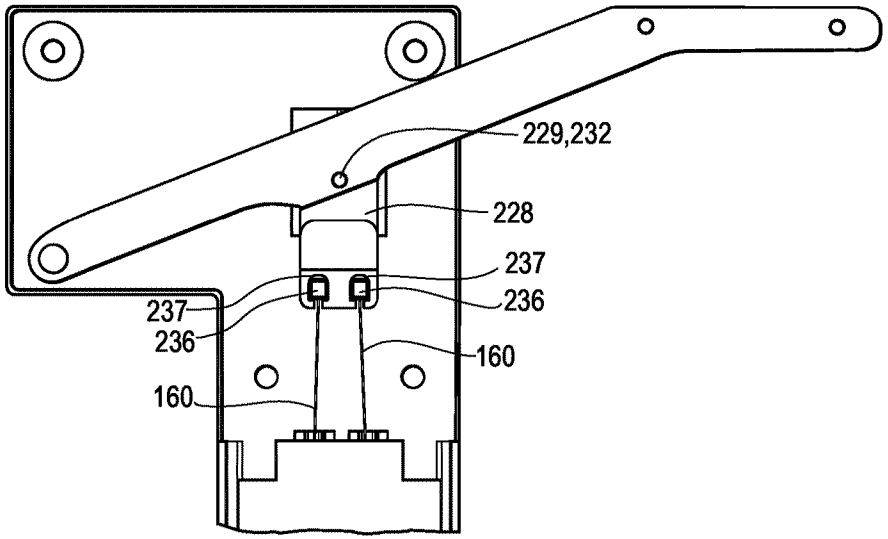
FIGS. 8A and B are bottom views of an actuation mechanism in locked and unlocked positions respectively.
Figure 8A:
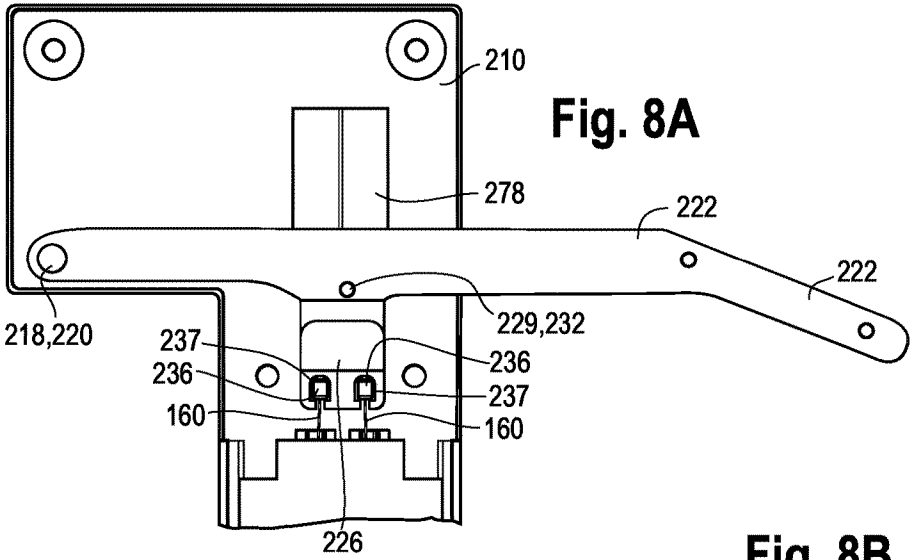
Figure 18C:
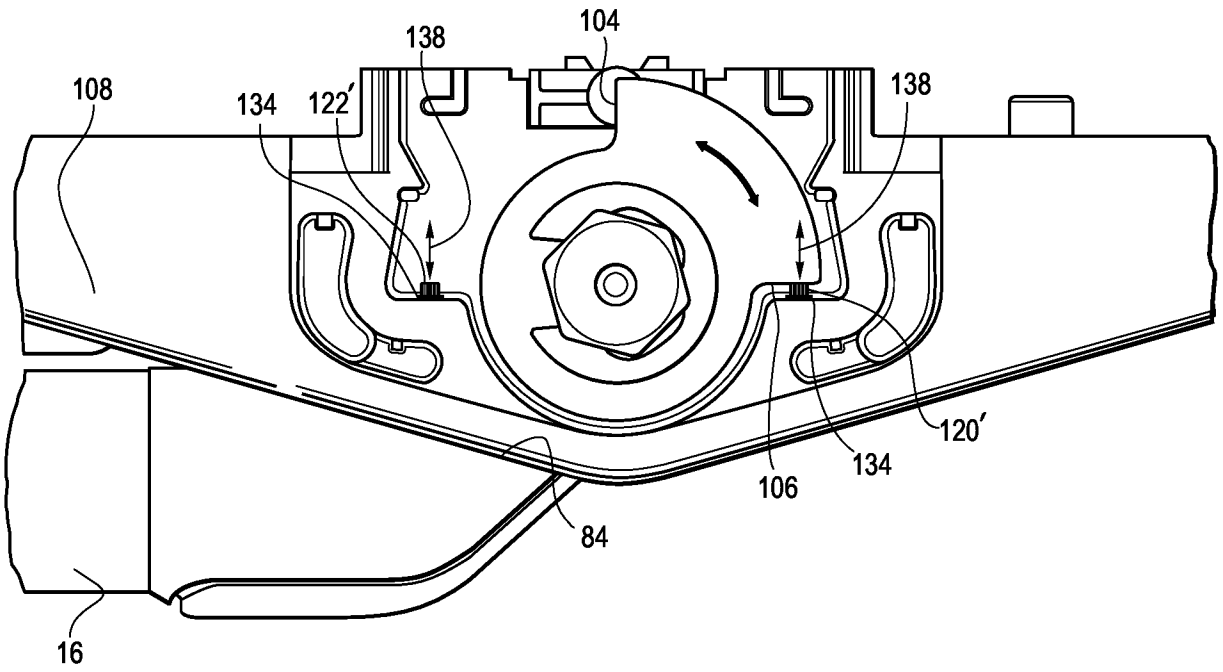
Figure 19:
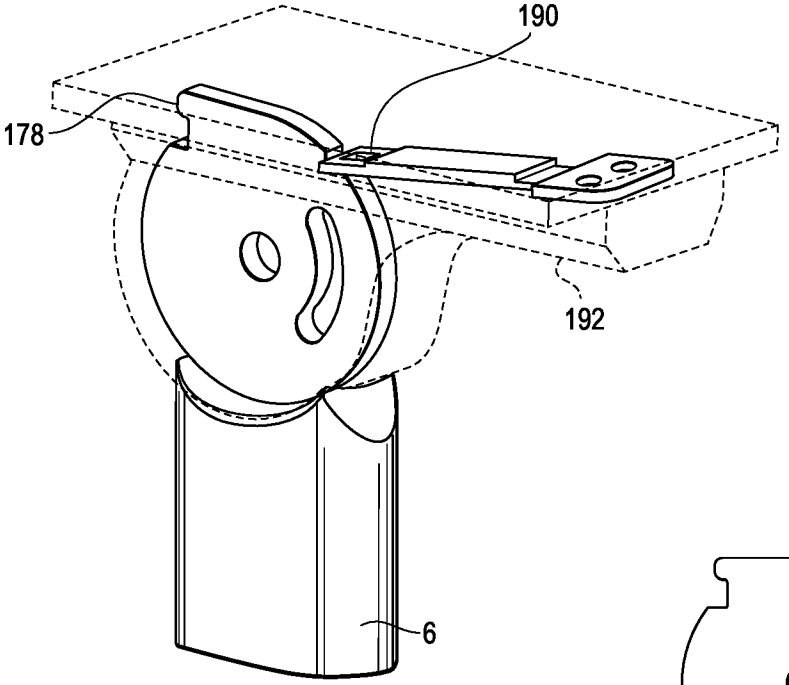
FIG. 19 is a perspective view of an alternative embodiment of a latch assembly.

In operation, and to move the worksurface to a stowed position, wherein the worksurface is upright, or substantially vertical, the user grasps the handle of the lever 222 and rotates the lever 214 about the first pivot axis 218 as shown in FIGS. 7 and 8B. As the lever is rotated, the lever pivots relative to the slider 226, with the pivot pin 232 moving within the slot 230, and thereby translates the slider along the track 228 within the housing. As the slider is translated, the cables 160 are simultaneously pulled, effecting a translation of the actuator plates 154 (FIG. 16A) or lock bolt 128 (FIGS. 7 and 30) connected to the opposite end 158 of the cable. The cable 160, with or without plate 154, in turn moves the lock bolt 128 relative to the strike plate 102 against the biasing force of the biasing member 132 from the engaged position to the disengaged position. The user may thereafter rotate the worksurface 150 from the use position to the stowed position, wherein the stop surface 104 of the strike plate engages the stop surface 122, 122' (or set screw) on the worksurface housing as shown in FIG. 18C. In the stowed position, also shown in FIG. 27, the bumper, or exterior surface of the cover 66, engages the worksurface. In this position, the leg and worksurface are spaced apart a distance $L_g$ sufficient to avoid a pinch point. In one embodiment, $L_g$ is 1.03 inches (26.13 mm).

The user may thereafter move the lever 222 back to the original position. However, since the lock bolt 128 is blocked by the strike plate 102 from moving back into the cavity 126 (see FIG. 18C (showing left side)), the lock bolt is prevented from being biased into the cavity by the biasing member 132. Accordingly, the cables 160 are not drawn or pulled by the lock bolt 128 and/or actuator plate 154. Instead, the ends of the cables 236, or barrels, move within the slots 234 or tracks formed in the slider. In this way, the lever may be returned to its original position but without the lock bolt reengaging, such that the worksurface is still rotatable back to the user position from the stowed position.

When the worksurface is returned to the use position, the biasing member 132 automatically biases the lock bolt 128 back to the engaged position, with the attendant movement of the actuator plate 154 drawing the cable ends 236 along the tracks 234 of the slider.

Panel Storage Hook

Referring to FIGS. 1A-2, 15A and B, a panel 300, such as a display panel, including for example a white board, may be secured to docks 302 arranged along opposite ends of the table, as disclosed for example in U.S. Pat. No. 9,066,589, assigned to Steelcase Inc., the same assignee for the present application. The entire disclosure of U.S. Pat. No. 9,066,589, including the description of the docks and panels, is hereby incorporated herein by reference. The panels include an opening 304 defining a handle 306.

A storage hook 308 includes a base 312 that is coupled to the bottom surface 114 of the worksurface, for example with a pair of fasteners 310. The storage hook may be made, for example, of metal or plastic. The base has a pair of spaced apart lugs 314 defining a pivot axis 316. A hook portion 318 has a body 320 pivotally connected to the lugs and a pair of spaced apart hooks 322. The space (G) between the hooks is sufficiently dimensioned to allow a user to insert their hand between the hooks and grasp the handle of the panel. The hooks 322 are also dimensioned and spaced such that the hooks may be inserted into the opening 304 of the panel. The hooks each include a bottom shelf 324 and an upturned portion 326. The shelf 324 may be wide enough to accommodate a plurality of panels.

In operation, one or more panels 300 are disposed on the hooks, which extend through the opening 304, with the handle resting on the bottom shelf 324. The upturned portion 326, or protuberance, prevents the panel from sliding off of the shelf 324. The panels 300 may be disposed on the hooks 322 when the worksurface is in either the use or stowed position.

The hook portion 320 and panel 300 disposed thereon are pivotable relative to the base 312 and worksurface 150 between a first position, wherein the panel 300 is positioned transverse to the worksurface 150, for example when the worksurface is in the use position, and a second position, wherein the panel 300 is positioned substantially parallel to the worksurface 150, for example when the worksurface is in the stowed position. It should be understood that the second positions may be other than a parallel orientation, with the angle between the panel and the worksurface simply changing between the first and second positions. The weight of the panel 300, applied to the hook portion 322, causes the hook portion 322 to automatically rotate between the first and second positions as the worksurface 150 is rotated between the use and stowed positions, without the need for any auxiliary biasing member. In the first position, the panel 300 serves as a privacy screen beneath the worksurface as shown in FIG. 1A. In the second position, the panel does not interfere with the nesting of adjacent tables.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A flip top table comprising:

a leg assembly;

a worksurface comprising a top and bottom surface, wherein the worksurface is rotatably supported by the leg assembly and is rotatable between a horizontal use position and an upright stowed position;

a storage hook comprising a base coupled to the bottom surface of the worksurface and a hook portion pivotally coupled to the base; and a panel supported by the hook portion, wherein the hook portion and panel are pivotable relative to the base and worksurface between a first position, wherein the hook portion and the panel are positioned transverse to the worksurface when the worksurface is in the use position, and a second position, wherein the hook portion and the panel are positioned substantially parallel to the worksurface when the worksurface is in the stowed position.

2. The flip top table of claim 1 wherein the panel comprises a display board.

3. The flip top table of claim 1 wherein the hook portion comprises a pair of spaced apart hooks, and wherein the panel comprises an opening defining a handle, wherein the hooks are removeably received in the opening.

4. The flip top table of claim 3 wherein the panel comprises a first panel, the opening comprises a first opening and the storage hook comprises a first storage hook, and further comprising a second storage hook spaced apart from the first storage hook, wherein the second storage hook comprises a second base coupled to the bottom surface of the worksurface and a second hook portion, and further comprising a second panel supported by the second hook portion, wherein the second panel is spaced apart from the first panel.

5. The flip top table of claim 1 wherein the worksurface comprises opposite ends, and further comprising a dock coupled to one of the opposite ends, wherein the panel is repositionable from a storage position, wherein the panel is removably supported by the hook portion, and a use position, wherein the panel is removably supported by the dock.

6. The flip top table of claim 1 wherein the hook portion comprises a shelf and an upturned portion, wherein the shelf is substantially horizontal when the hook portion is in the first and second positions, and wherein the upturned portion is substantially vertical when the hook portion is in the first and second positions.

7. The flip top table of claim 6 further comprising a plurality of panels supported by the shelf of the hook portion in the first and second positions.

8. The flip top table of claim 6 wherein end portions of the upturned portion are spaced apart from the bottom surface of the worksurface when the worksurface is in the use position.

9. The flip top table of claim 6 wherein the worksurface is rotatable about an axis, and wherein the panel extends away from the axis toward a bottom edge of the worksurface when the worksurface is in the upright stowed position.

10. A method of supporting a panel on a flip top table comprising:

rotating a worksurface relative to a leg assembly between a horizontal use position and an upright stowed position;

supporting a panel on a hook portion pivotally coupled to a bottom of the worksurface, wherein the hook portion and the panel extend transverse to the worksurface when the worksurface is in the use position; and rotating the panel and hook portion relative to the worksurface as the worksurface is rotated to the stowed position, wherein the hook portion and the panel extend parallel to the worksurface when the worksurface is in the stowed position.

11. The method of claim 10 wherein the panel comprises a display board.

12. The method of claim 10 wherein the hook portion comprises a pair of spaced apart hooks and wherein the panel comprises an opening defining a handle, and wherein supporting the panel on the hook portion comprises inserting the hooks through the opening.

13. A flip top table comprising:

a leg assembly;

a worksurface comprising a top and bottom surface, wherein the worksurface is rotatably supported by the leg assembly and is rotatable between a horizontal use position and an upright stowed position;

a storage hook coupled to the bottom surface of the worksurface, wherein the storage hook comprises a hook portion pivotable relative to the bottom surface of the worksurface, wherein the hook portion is pivotable relative to the worksurface between a first position, wherein the hook portion extends transverse to the worksurface and opens upwardly when the worksurface is in the use position, and a second position, wherein the hook portion extends parallel to the worksurface and opens upwardly when the worksurface is in the stowed position, wherein the hook portion is configured to support a panel in both the first and second positions.

14. The flip top table of claim 13 further comprising a panel supported by the hook portion, wherein the panel is pivotable relative to the base and worksurface between a first position, wherein the panel is positioned transverse to the worksurface when the worksurface is in the use position, and a second position, wherein the panel is positioned substantially parallel to the worksurface when the worksurface is in the stowed position.

15. The flip top table of claim 14 wherein the panel comprises a display board.

16. The flip top table of claim 14 wherein the hook portion comprises a pair of spaced apart hooks, and wherein the panel comprises an opening defining a handle, wherein the hooks are removeably received in the opening.

17. The flip top table of claim 14 wherein the worksurface comprises opposite ends, and further comprising a dock coupled to one of the opposite ends, wherein the panel is repositionable from a storage position, wherein the panel is removably supported by the hook portion, and a use position, wherein the panel is removably supported by the dock.

18. The flip top table of claim 13 wherein the panel comprises a first panel, the opening comprises a first opening and the storage hook comprises a first storage hook, and further comprising a second storage hook spaced apart from the first storage hook and coupled to the bottom surface of the worksurface, wherein the second storage hook comprises a second hook portion pivotable relative to the bottom surface of the worksurface, wherein the second hook portion is adapted to support the panel.

19. The flip top table of claim 13 wherein the hook portion comprises a shelf and an upturned portion, wherein the shelf is substantially horizontal when the hook portion is in the first and second positions, and wherein the upturned portion is substantially vertical when the hook portion is in the first and second positions.

20. The flip top table of claim 19 further comprising a plurality of panels supported by the shelf of the hook portion in the first and second positions.

21. The flip top table of claim 13 wherein the worksurface comprises opposite ends, and further comprising a dock coupled to one of the opposite ends, wherein the panel is repositionable from a storage position, wherein the panel is removably supported by the hook portion, and a use position, wherein the panel is removably supported by the dock.

* * * * *